US011298808B1

(12) United States Patent
Kuo

(10) Patent No.: US 11,298,808 B1
(45) Date of Patent: Apr. 12, 2022

(54) TORQUE STRUCTURE

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 0 days.

(21) Appl. No.: 17/366,352

(22) Filed: Jul. 2, 2021

(51) Int. Cl.
*B25B 23/142* (2006.01)
*B25B 23/14* (2006.01)

(52) U.S. Cl.
CPC ..... *B25B 23/1427* (2013.01); *B25B 23/141* (2013.01)

(58) Field of Classification Search
CPC .. B25B 23/1427; B25B 23/141; B25B 23/142
USPC ..... 81/473, 478, 475, 474, 480
See application file for complete search history.

(56) References Cited

U.S. PATENT DOCUMENTS 8,371,194 B2 2/2013 Wu et al.
2017/0095911 A1* 4/2017 Hsieh ..... B25B 23/1427

FOREIGN PATENT DOCUMENTS

TW I372097 B 9/2012

* cited by examiner

*Primary Examiner* — Joseph J Hail
*Assistant Examiner* — Caleb Andrew Holizna
(74) *Attorney, Agent, or Firm* — Karin L. Williams; Mayer & Williams PC

(57) ABSTRACT

A torque structure includes a first body provided with a first receiving chamber, a first indicator, and a second receiving chamber, a second body provided with a drive portion, a first elastic member biased against the drive portion, a first locking set received in the first receiving chamber, an adjusting set driven by the first body, an indication unit movable to indicate the torque of the torque structure, a third body assembly covering the indication unit, a second locking set rotatable relative to the first locking set, and a third locking set operable between a locking position where the first body cannot be rotated relative to the second body and an unlocking position where the first body is rotated relative to the second body to adjust the torque.

10 Claims, 16 Drawing Sheets

TORQUE STRUCTURE

BACKGROUND OF THE INVENTION

1. Field of the Invention

The present invention relates to a hand tool and, more particularly, to a torque structure.

2. Description of the Related Art

A conventional wrench 10 was disclosed in the U.S. Pat. No. 8,371,194 (or Taiwanese Patent Publication No. 1372097), and comprises a shank 11, a head 12, a handle 13, a torque assembly 20, a torque-setting device 30 and a torque-measuring device 50. The shank 11 is a tubular element with a slot 14. The handle 13 is attached to an end of the shank 11. The handle 13 includes a window 56 defined therein. A lens 57 is fit in the window 56. The torque assembly 20 is located in the shank 11. The head 12 is attached to an opposite end of the shank 11 via the torque assembly 20. The torque-setting device 30 includes a knob assembly 31, a bolt 35, a pusher 38 and a pin 32. The pusher 38 is located in the shank 11, against the spring 21. The pin 32 is transversely driven in the pusher 38 via the slot 14. The torque-measuring device 50 includes a measurement sleeve 60, a cover 70 and a collar 80. A ring 63 includes teeth engaged with the teeth 62 of the measurement sleeve 60 so that the ring 63 can spin together with the measurement sleeve 60. A scale 64 is provided on a sticker attached to the ring 63. The scale 64 includes notches 54 and numerals 55. The collar 80 includes a reduced section 82 formed at an end and a raised portion 83 formed thereon. A window 51 is defined in the raised portion 83 of the collar 80. A lens 52 is fit in the window 51. The lens 52 is made with a pointer 53. The collar 80 is located around the shank 11. The window 51 is aligned with the scale 64 so that the scale 64 is clearly observable via the lens 52 (FIG. 5). The collar 80 is secured to the shank 11 by screws 81.

However, the conventional wrench 10 has the following disadvantages.

1. The knob assembly 31 is rotated to adjust the torque. The knob assembly 31 has a smaller volume so that the user cannot hold and drive the knob assembly 31 easily, thereby causing inconvenience in adjustment of the torque.

2. The handle 13 is arranged between the notches 54 and the window 56 so that the notches 54 and the window 56 are spaced from each other and obstructed by the handle 13. The user has to watch the notches 54 and the window 56 simultaneously when adjusting the torque so that the arrangement of the notches 54 and the window 56 does not satisfy the ergonomic design, and the user cannot observe the notches 54 and the window 56 clearly, thereby causing inconvenience to the user in adjustment of the torque.

3. The groove 61 is formed in the inner face of the measurement sleeve 60. The groove 61 is not worked easily, thereby increasing the cost of fabrication.

4. The groove 61 allows movement of the pin 32 and allows rotation of the ring 63. The distance of movement of the pin 32 cannot match that of rotation of the ring 63 through a cycle.

BRIEF SUMMARY OF THE INVENTION

In accordance with the present invention, there is provided a torque structure comprising a first body provided with a first receiving chamber, a first indicator, and a second receiving chamber, a second body provided with a drive portion, a first elastic member biased against the drive portion, a first locking set received in the first receiving chamber, an adjusting set driven by the first body, an indication unit movable to indicate the torque of the torque structure, a third body assembly covering the indication unit, a second locking set rotatable relative to the first locking set, and a third locking set operable between a locking position where the first body cannot be rotated relative to the second body and an unlocking position where the first body is rotated relative to the second body to adjust the torque.

According to the primary advantage of the present invention, the first body has a larger volume and length to provide a better rotation force when adjusting the torque so that the user directly holds and rotates the first body to satisfy the ergonomic requirement. The first indicator and the indication unit are situated at the mediate position of the torque structure and are close to each other so that the user directly watches the first indicator and the indication unit when holding the first body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
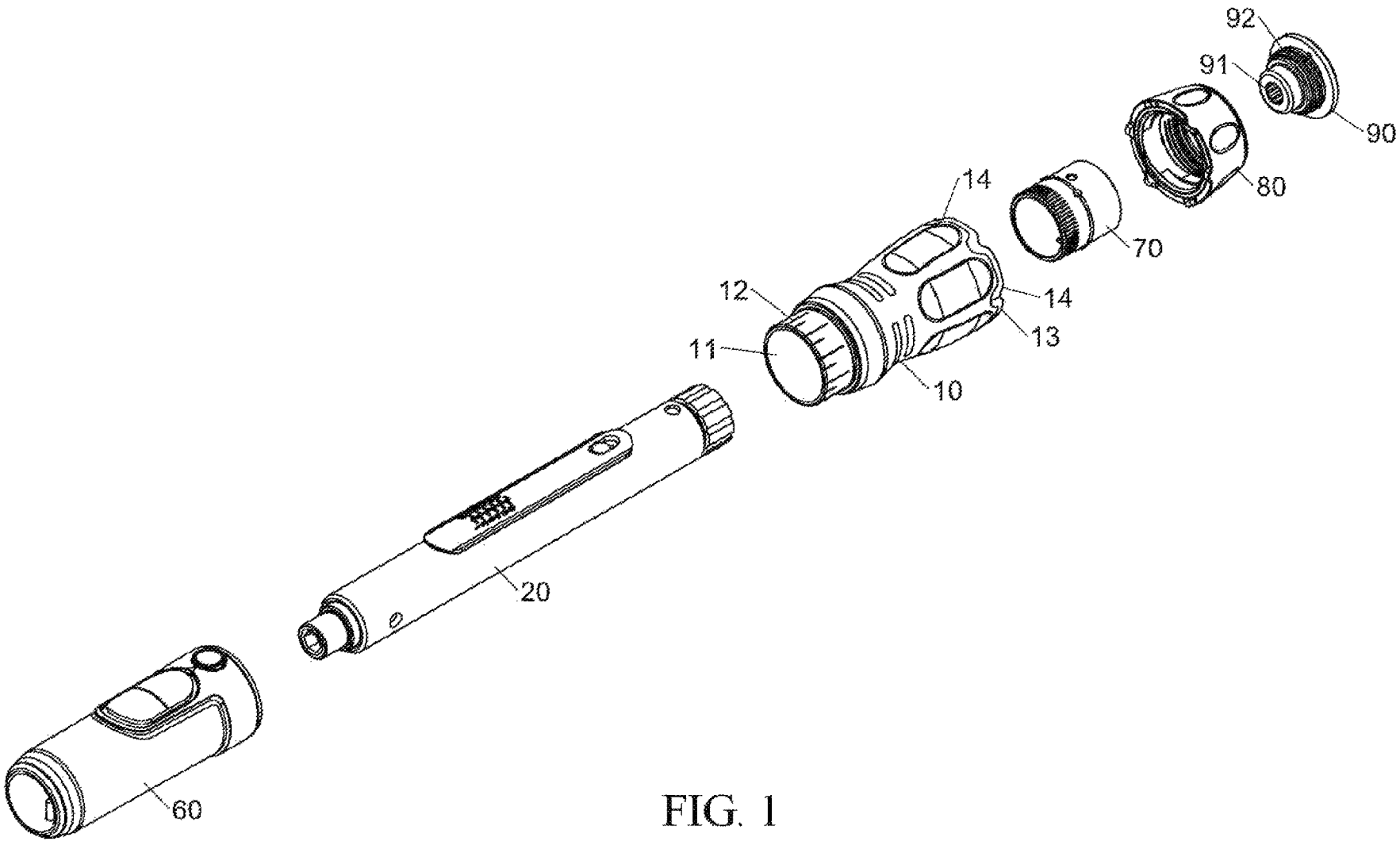
FIG. 1 is an exploded perspective view of a torque structure in accordance with the preferred embodiment of the present invention.
Figure 2:
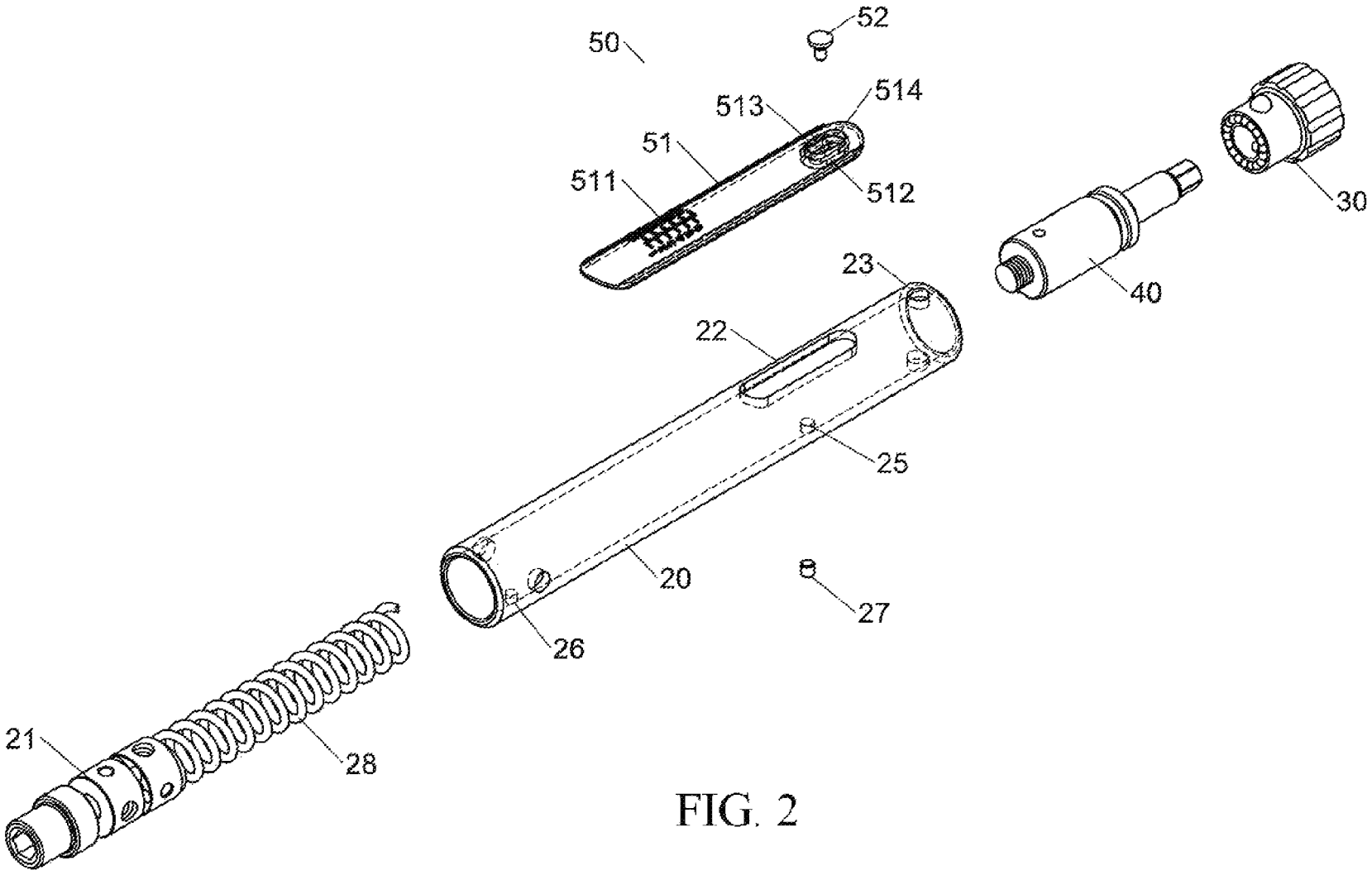
FIG. 2 is a partial exploded perspective view of the torque structure in accordance with the preferred embodiment of the present invention.
Figure 3:
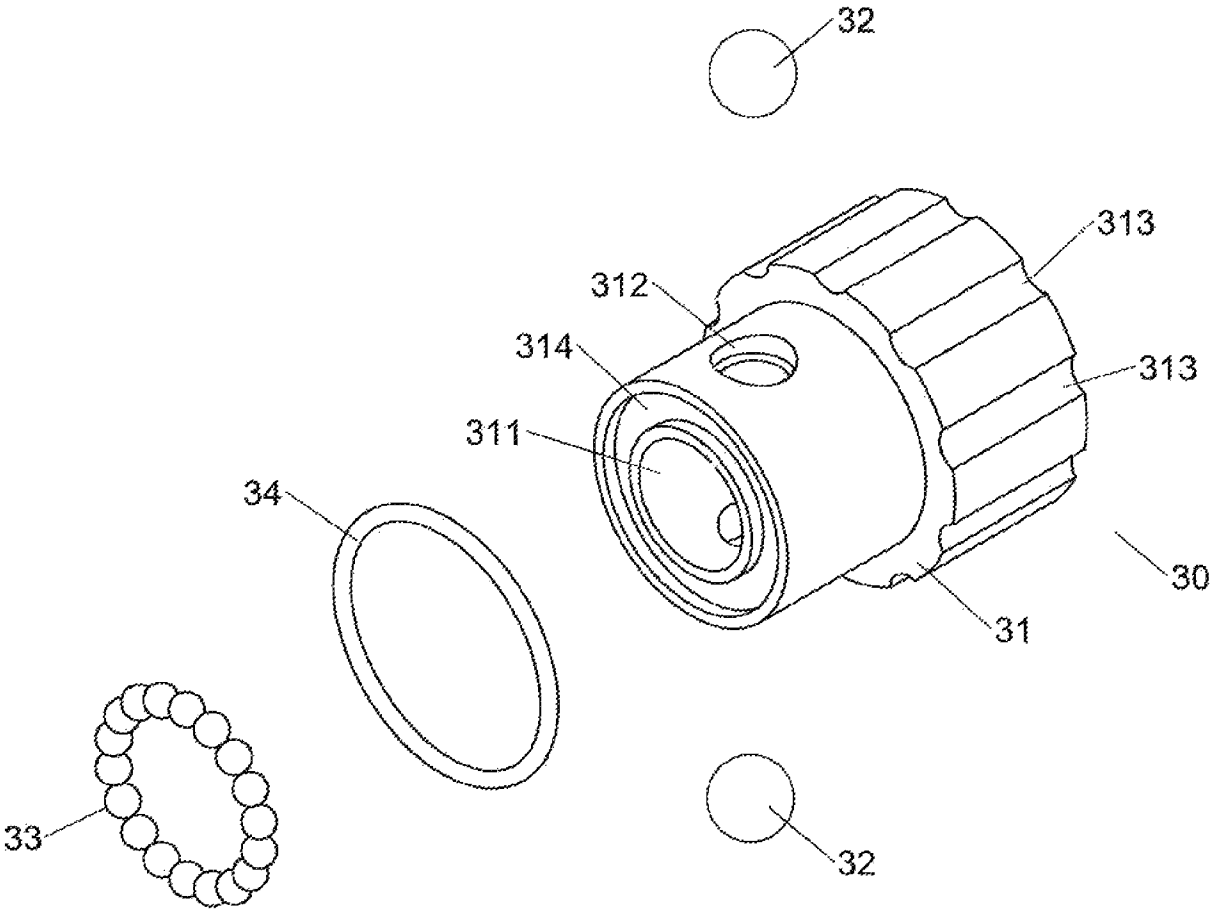
FIG. 3 is an exploded perspective view of a first locking set of the torque structure in accordance with the preferred embodiment of the present invention.
Figure 4:
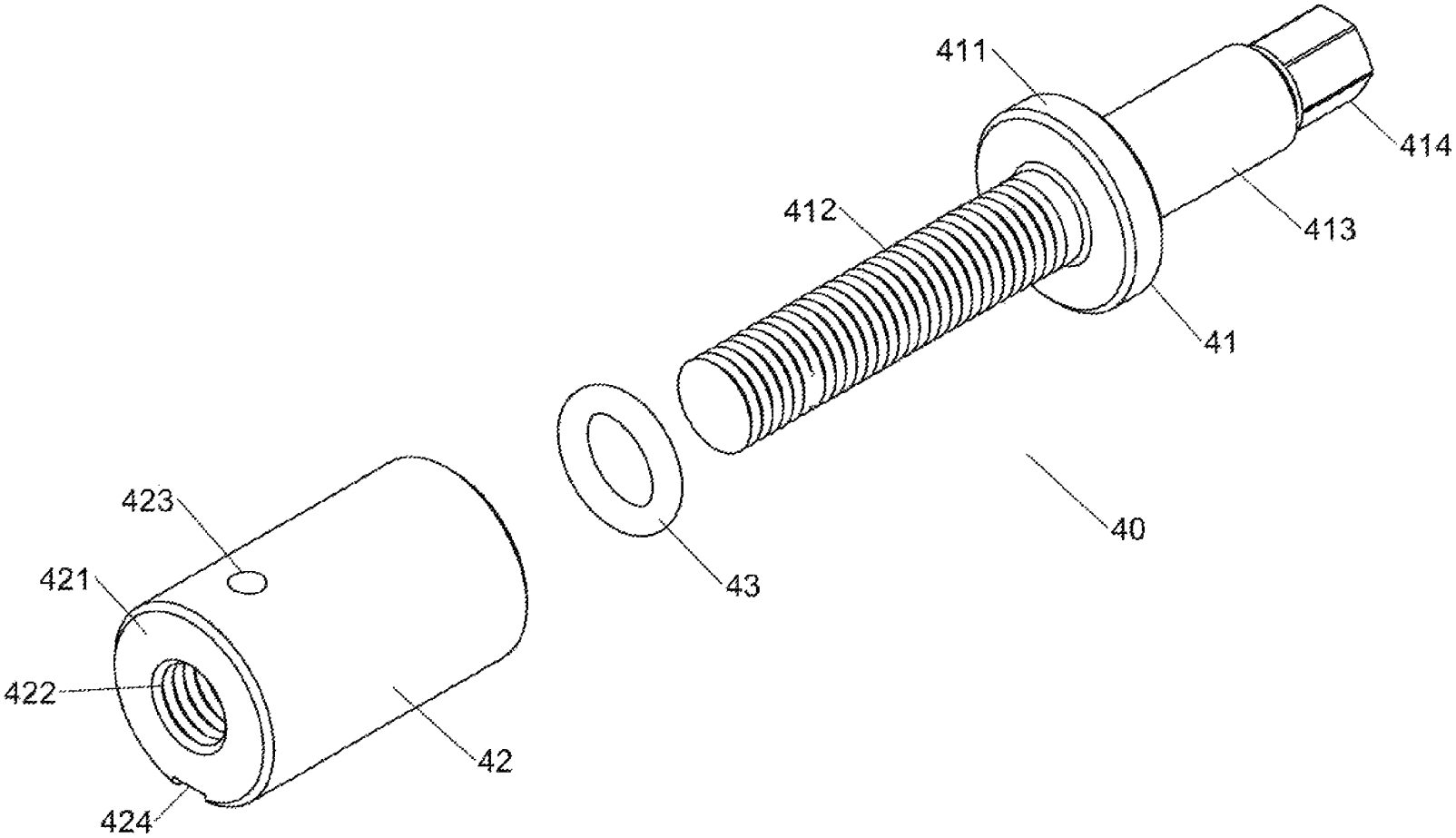
FIG. 4 is an exploded perspective view of an adjusting set of the torque structure in accordance with the preferred embodiment of the present invention.
Figure 5:
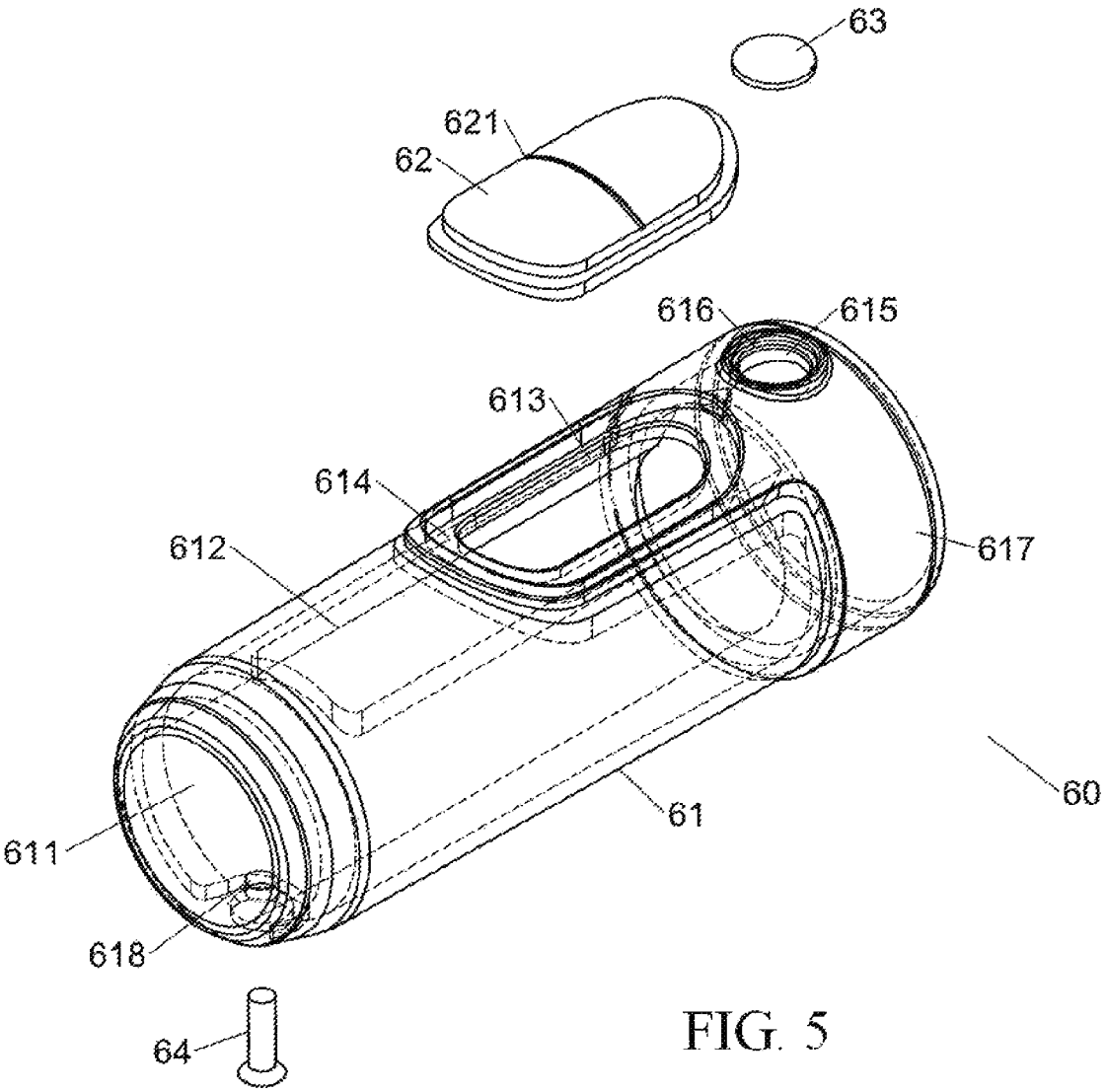
FIG. 5 is an exploded perspective view of a third body assembly of the torque structure in accordance with the preferred embodiment of the present invention.
Figure 6:
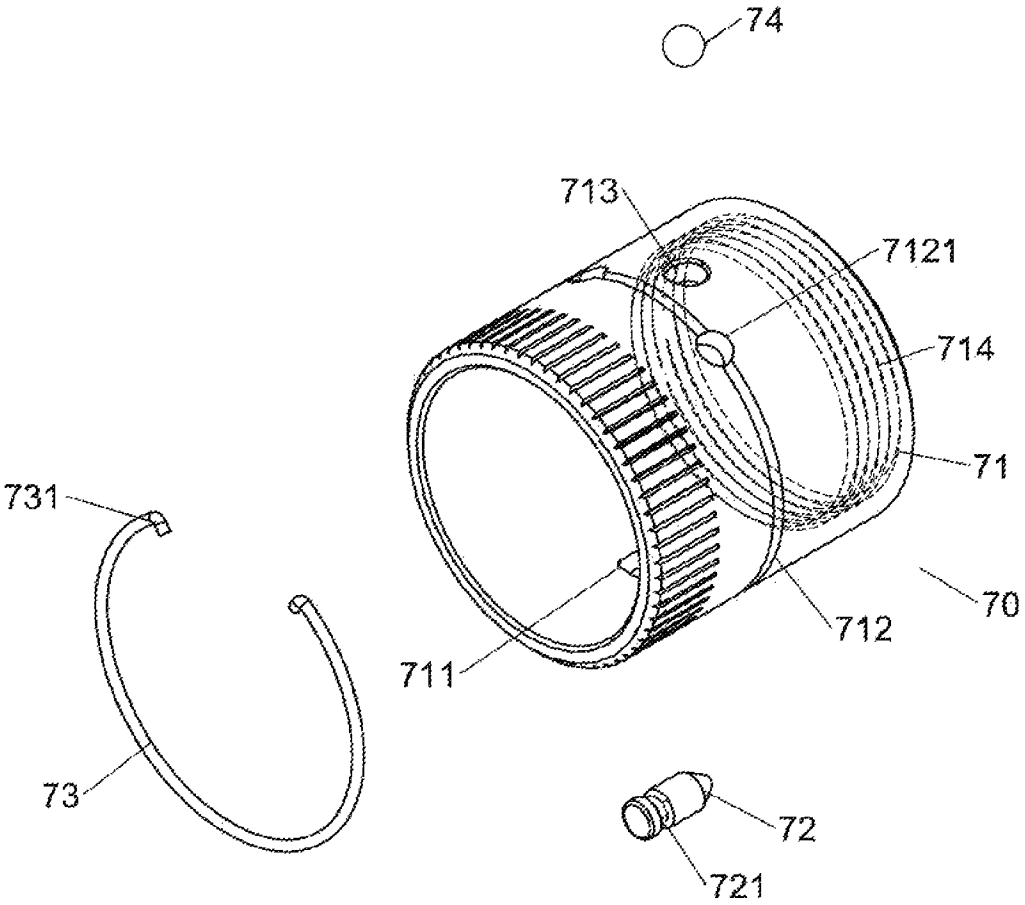
FIG. 6 is an exploded perspective view of a second locking set of the torque structure in accordance with the preferred embodiment of the present invention.
Figure 7:
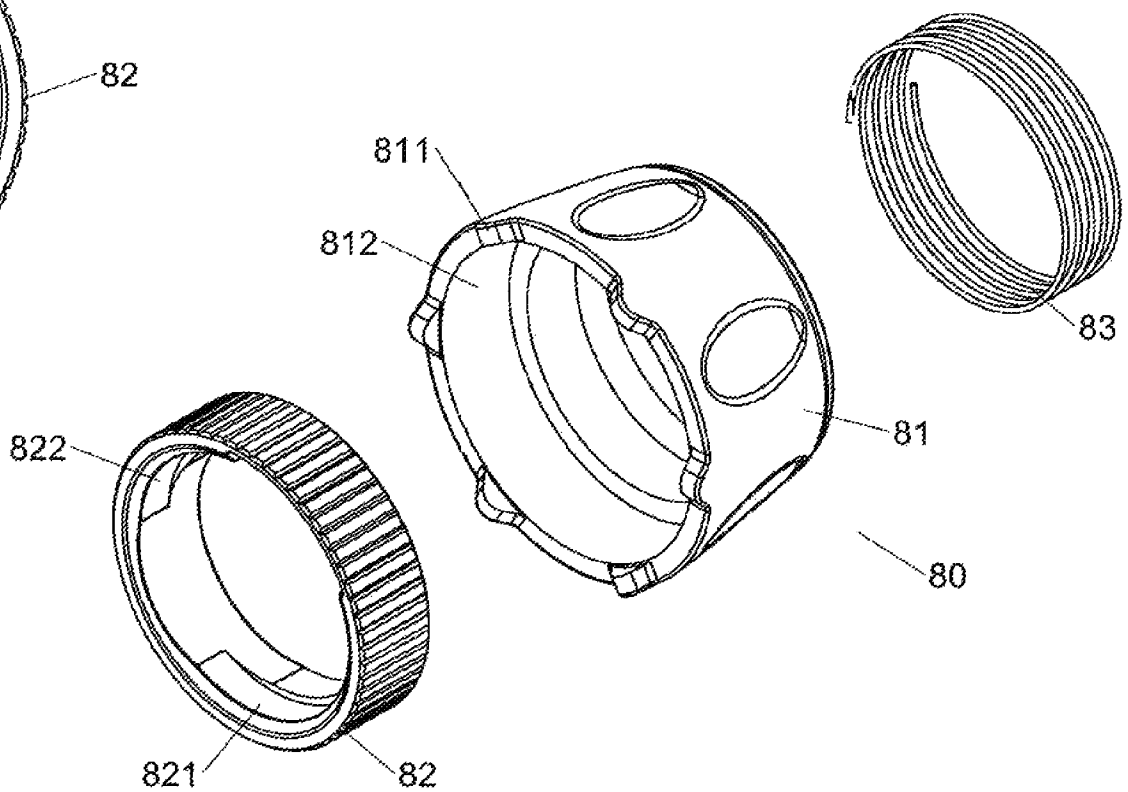
FIG. 7 is an exploded perspective view of a third locking set of the torque structure in accordance with the preferred embodiment of the present invention.

Referring to the drawings and initially to FIGS. 1-9, a torque structure in accordance with the preferred embodiment of the present invention comprises a first body 10, a second body 20, a first limit member 27, a first elastic member 28, a first locking set 30, an adjusting set 40, an indication unit 50, a third body assembly 60, a second locking set 70, a third locking set 80, and a fourth body 90.

The first body 10 is held by a user and rotated to adjust the torque of the torque structure. The first body 10 has an interior provided with a first receiving chamber 11. The first receiving chamber 11 has a circular shape and penetrates the first body 10. The first body 10 has a first end provided with a first indicator 12 and a second end provided with a second receiving chamber 13 and a plurality of first positioning portions 14. The first indicator 12 has a plurality of graduations (or scales) which are spaced and arranged in an annular shape. The second receiving chamber 13 has a circular shape and is connected to the first receiving chamber 11. The first positioning portions 14 are arranged at an opening of the second receiving chamber 13 and are distant from the first indicator 12. Each of the first positioning portions 14 is a cutout. Preferably, the first body 10 has six first positioning portions 14 which are spaced and arranged in an annular shape about an axis of the first body 10.

The second body 20 is pivotally connected with the first body 10 which is rotated relative to the second body 20 to adjust the torque of the torque structure. The second body 20 is partially received in the first receiving chamber 11 and has a first end provided with a drive portion 21 and a first fitting portion 26 and a second end provided with a first guide slot 22 and a plurality of first securing portions 23. The drive portion 21 partially protrudes from the first body 10 and is preferably a hexagonal recess, a square head or a wrench head. The first guide slot 22 has an elongate shape and has a lengthwise direction corresponding to that of the second body 20. The first guide slot 22 is hidden in the first receiving chamber 11 and is distant from the drive portion 21. The first guide slot 22 is arranged between the drive portion 21 and the first securing portions 23. The first securing portions 23 are arranged in an annular shape about an axis of the second body 20. Each of the first securing portions 23 is a circular hole. The second body 20 is provided with a first receiving hole 25 hidden in the first receiving chamber 11. The first receiving hole 25 has a circular shape and aligns with the first guide slot 22. The first fitting portion 26 is a hole.

The first limit member 27 is received in the first receiving hole 25. The first elastic member 28 is received in the second body 20 and biased against the drive portion 21 of the second body 20 so that the second body 20 has a torque slip (or tipping) function.

The first locking set 30 is assembled with and cannot be moved or rotated relative to the second body 20. The first locking set 30 is received in the first receiving chamber 11 and includes a first locking member 31, a plurality of securing members 32, a plurality of balls (or beads) 33, and a first washer (or O-ring) 34.

The first locking member 31 is assembled with and cannot be moved or rotated relative to the second body 20. The first locking member 31 is hidden in the first receiving chamber 11 and is distant from the drive portion 21. The first locking member 31 has an interior provided with a first pivot portion 311 which has a circular shape and penetrates the first locking member 31. The first locking member 31 is provided with a plurality of second securing portions 312 aligning with the first securing portions 23 and having a number corresponding to that of the first securing portions 23. The first locking member 31 has a first end provided with a plurality of positioning channels 313 and a second end provided with a ball groove 314. The positioning channels 313 are arranged in an annular shape about an axis of the first locking member 31. Each of the positioning channels 313 has an arcuate shape. The ball groove 314 has an annular shape and is close to an opening of the first pivot portion 311.

The securing members 32 is mounted in the first securing portions 23 and the second securing portions 312 so that the first locking member 31 is secured to the second body 20. The securing members 32 have a number corresponding to that of the first securing portions 23 and that of the second securing portions 312. Each of the securing members 32 is a ball or a pin.

The balls 33 are arranged to form a ring and are rotatably mounted in the ball groove 314.

The first washer 34 is mounted on the first locking member 31 and located between the second body 20 and the first locking member 31. The first washer 34 is arranged between the second end of the second body 20 and the positioning channels 313. The first washer 34 is elastic to eliminate the gap between the second body 20 and the first locking member 31.

The adjusting set 40 is assembled with the second body 20 and the first locking set 30 and directly or indirectly pushes the first elastic member 28. When the first body 10 is rotated relative to the second body 20, the adjusting set 40 is driven by the first body 10 to adjust the torque of the torque structure. The adjusting set 40 includes an adjusting member 41, a seat 42, and a second washer (or O-ring) 43.

The adjusting member 41 extends through and is rotatable in the second body 20 and the first pivot portion 311. The adjusting member 41 includes a first screwing portion 412, a spacer 411, and a second pivot portion 413. The spacer 411 is received in the second body 20 and arranged between the first screwing portion 412 and the second pivot portion 413. The spacer 411 has a circular shape and rests on the balls 33 to provide a rolling friction when the adjusting member 41 is rotated relative to the first locking member 31. The first screwing portion 412 is received in the second body 20. The first screwing portion 412 is an external thread and has a diameter less than that of the spacer 411. The second pivot portion 413 is pivotally mounted in the first pivot portion 311 and is rotated relative to the first locking member 31. The second pivot portion 413 is a circular rod and has a diameter less than that of the spacer 411. The second pivot portion 413 is provided with a first mounting portion 414 that is a hexagonal head. The second pivot portion 413 is arranged between the spacer 411 and the first mounting portion 414.

The seat 42 is received in the second body 20 and has an end provided with an abutting face 421 that directly or indirectly rests on the first elastic member 28 so that the first elastic member 28 is biased between the drive portion 21 of the second body 20 and the abutting face 421. The seat 42 has an interior provided with a second screwing portion 422 screwed with the first screwing portion 412. The second screwing portion 422 is an internal thread and is rotated relative to the first screwing portion 412 so that the seat 42 is moved relative to the spacer 411 and is moved linearly in the second body 20 to adjust a compression degree of the first elastic member 28. The seat 42 is provided with a second receiving hole 423 aligning with the first guide slot 22. The second receiving hole 423 has a circular shape and has an axis perpendicular to that of the seat 42. The seat 42 is provided with a second guide slot 424 aligning with the first receiving hole 25. The first limit member 27 is received in the second guide slot 424 and arranged between the first receiving hole 25 and the second guide slot 424 so that the second guide slot 424 is movable on the first limit member 27. Thus, the seat 42 is limited by the first limit member 27 and is moved linearly in the second body 20. The second guide slot 424 has an elongate shape and extends in a lengthwise direction of the seat 42.

The second washer 43 is mounted on the first screwing portion 412 and received in the second body 20. The second washer 43 is arranged between the spacer 411 of the adjusting member 41 and the seat 42. Thus, the seat 42 is moved relative to the adjusting member 41 to rest on or leave the second washer 43.

The indication unit 50 is assembled with the first body 10, the second body 20, and the adjusting set 40. When the adjusting set 40 is driven by the first body 10, the indication unit 50 is moved to indicate the torque of the torque structure. The indication unit 50 includes an indicating member 51 and a second limit member 52.

The indicating member 51 protrudes from the second body 20 and is partially received in the first receiving chamber 11. The indicating member 51 is arranged between the first body 10 and the second body 20 and assembled with the adjusting set 40. When the adjusting set 40 is driven by the first body 10, the indicating member 51 is moved linearly outside the second body 20. The indicating member 51 is assembled with the seat 42 which drives the indicating member 51 to move linearly outside the second body 20. The indicating member 51 is provided with a second indicator 511 having a plurality of graduations (or scales) which are spaced and arranged linearly. The indicating member 51 is provided with a projection 512 which is movably mounted in the first guide slot 22 so that the indicating member 51 is moved linearly relative to the second body 20. The projection 512 has an oblong shape and has an interior provided with a first recess 513 aligning with the second receiving hole 423. The first recess 513 has an elongate shape and has an end provided with a second recess 514 connected to the first recess 513. The second recess 514 has an elongate shape and has a length and a diameter more than that of the first recess 513. The first recess 513 is arranged between the projection 512 and the second recess 514.

The second limit member 52 extends through the second receiving hole 423, the first recess 513, and the second recess 514, so that the indicating member 51 is assembled with the seat 42. The second limit member 52 is a rivet or a screw member and has as head received in the second recess 514.

In practice, when the first screwing portion 412 is rotated relative to the second screwing portion 422, the seat 42 is limited by the first limit member 27 and is moved linearly in the second body 20, so that the abutting face 421 is moved to abut the first elastic member 28 to adjust the degree of compression of the first elastic member 28. At the same time, the seat 42 drives and moves the second limit member 52 which drives the projection 512 to move in the first guide slot 22. At this time, the indicating member 51 is limited by the second limit member 52 and the projection 512, so that the indicating member 51 and the second limit member 52 are moved linearly relative to the first body 10 and the second body 20.

The third body assembly 60 is pivotally connected with the first body 10 which is rotatable relative to the second body 20, the first locking set 30, and the third body assembly 60. The third body assembly 60 is assembled with and cannot be moved relative to the second body 20. The third body assembly 60 covers the indication unit 50 which is moved in the third body assembly 60. The third body assembly 60 includes a third body 61, a first cover 62, a second cover 63, and a fitting member 64.

The third body 61 is assembled with the second body 20 and has a first end provided with a third receiving chamber 611 for partially receiving the second body 20. The drive portion 21 partially protrudes from the third body 61. The indication unit 50 is received in the first receiving chamber 11 and the third receiving chamber 611. The third receiving chamber 611 has a circular shape and has a side provided with a slideway 612 for receiving the indicating member 51. The indicating member 51 slides linearly in the slideway 612 by guidance of the first guide slot 22. The slideway 612 is connected to the third receiving chamber 611. The third body 61 is provided with a first hollow 613 aligning with the second indicator 511 which is moved relative to the first hollow 613 to indicate a torque value that represents the degree of compression of the first elastic member 28 pressed by the adjusting set 40. The first hollow 613 is an elongate slot that is connected to the slideway 612. The third body 61 has an exterior provided with a first receiving groove 614 having an elongate shape and having a length and a diameter more than that of the first hollow 613. The first hollow 613 is arranged between the slideway 612 and the first receiving groove 614. The third body 61 has a second end provided with a second hollow 615 and a fourth receiving chamber 617. The first body 10 is rotatable relative to the third body 61 to align each of the graduations of the first indicator 12 with the second hollow 615. The second hollow 615 is a circular slot and has an end provided with a second receiving groove 616 connected to the second hollow 615. The second receiving groove 616 has a circular shape and has a diameter less than that of the second hollow 615. The fourth receiving chamber 617 is connected to the third receiving chamber 611 and receives the first indicator 12 which is rotatable in the fourth receiving chamber 617. The fourth receiving chamber 617 has a circular shape and has a diameter less than that of the third receiving chamber 611. The third body 61 is provided with a second fitting portion 618 aligning with the first fitting portion 26. The second fitting portion 618 is a through hole and is close to an opening of the third receiving chamber 611.

The first cover 62 is received in the first receiving groove 614 and covers the first hollow 613. The first cover 62 is transparent or translucent and is provided with an indicating portion 621. The indicating member 51 is moved relative to the third body 61 to align each of the graduations of the second indicator 511 with the indicating portion 621 to indicate the torque value that represents the degree of compression of the first elastic member 28 pressed by the adjusting set 40.

The second cover 63 is received in the second receiving groove 616 and covers the second hollow 615. The second cover 63 is transparent or translucent and has a circular shape. The second cover 63 has a magnifying function. Preferably, the second cover 63 is a magnifier.

The fitting member 64 extends through the second fitting portion 618 and the first fitting portion 26 so that the third body 61 is secured to the second body 20. The fitting member 64 is an anchor, a rivet or a screw member.

The second locking set 70 is assembled with the first body 10 and is rotatable relative to the first locking set 30. The second locking set 70 includes a second locking member 71, a first positioning member 72, a ring 73, and a second positioning member 74.

The second locking member 71 is partially mounted in the second receiving chamber 13. Preferably, the second locking member 71 is closely fit into the second receiving chamber 13, so that the second locking member 71 is secured to and rotated with the first body 10. The second locking member 71 is provided with a first perforation 711 that penetrates the second locking member 71. The first perforation 711 is an elongate slot and aligns with one of the positioning channels 313. The second locking member 71 has an outer face provided with a first annular groove 712. The first annular groove 712 is provided with two retaining holes 7121 which are arranged symmetrically relative to the first perforation 711. The second locking member 71 is provided with a second perforation 713 aligning with one of the positioning channels 313. The second perforation 713 has a circular shape and aligns with the first perforation 711. The two retaining holes 7121 are arranged between the first perforation 711 and the second perforation 713. The second locking member 71 has an inner face provided with a third screwing portion 714 that is an internal thread.

The first positioning member 72 is received in the first perforation 711. The first positioning member 72 is made of metal and has column shape. The first positioning member 72 is provided with a second annular groove 721 and a conic portion. The conic portion is directed toward the third screwing portion 714.

The ring 73 is mounted on the first annular groove 712 and the second annular groove 721. The ring 73 is a C-shaped snap ring having elasticity and has two retaining portions 731 formed on two ends thereof. The two retaining portions 731 are retained in the two retaining holes 7121 so that the ring 73 is secured to and is not detached from the second locking member 71. Thus, the first positioning member 72 is limited by the ring 73 and will not be detached from the first perforation 711.

The second positioning member 74 is received in the second perforation 713. Preferably, the second positioning member 74 is a ball or bead.

The third locking set 80 is assembled with the first body 10 and the second locking set 70. The third locking set 80 is operable between a locking position where the third locking set 80 restricts the second locking set 70 and the first locking set 30 so that the first body 10 cannot be rotated relative to the second body 20 and an unlocking position where the third locking set 80 releases the second locking set 70 and the first locking set 30 so that the first body 10 is rotated relative to the second body 20 to adjust the torque of the torque structure. The third locking set 80 is moved relative to the first body 10 so that a distance is defined between the third locking set 80 and the first body 10. The third locking set 80 is rotated through an angle to the unlocking position after displacement of the third locking set 80 relative to the first body 10. The third locking set 80 includes a third locking member 81, a control ring 82, and a second elastic member 83.

The third locking member 81 is assembled with the first body 10 and moved and rotated relative to the first body 10. The third locking member 81 is provided with a plurality of second positioning portions 811 aligning with the first positioning portions 14. The third locking set 80 is disposed at the locking position when the second positioning portions 811 engage the first positioning portions 14 and disposed at the unlocking position when the second positioning portions 811 disengage the first positioning portions 14. The second positioning portions 811 have a shape corresponding to that of the first positioning portions 14. The third locking member 81 has an interior provided with a fifth receiving chamber 812 having a circular shape.

The control ring 82 is mounted in the fifth receiving chamber 812. Preferably, the control ring 82 is closely fitted into the fifth receiving chamber 812 so that the control ring 82 is secured to the third locking member 81 and moved and rotated with the third locking member 81. The first positioning member 72, the ring 73, and the second positioning member 74 are hidden in the control ring 82 (see FIG. 12). The control ring 82 is moved and rotated on the second locking member 71. The control ring 82 has an inner face provided with a first recessed portion 821 and a second recessed portion 822. Each of the first recessed portion 821 and the second recessed portion 822 has an arcuate concave shape and has a minimum (or shallow) position and a maximum (or deep) position.

Figure 8:
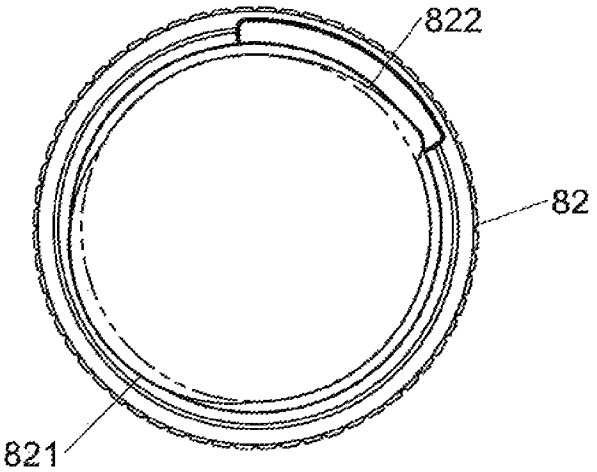
FIG. 8 is a front view of a control ring of the torque structure in accordance with the preferred embodiment of the present invention.
Figure 9:
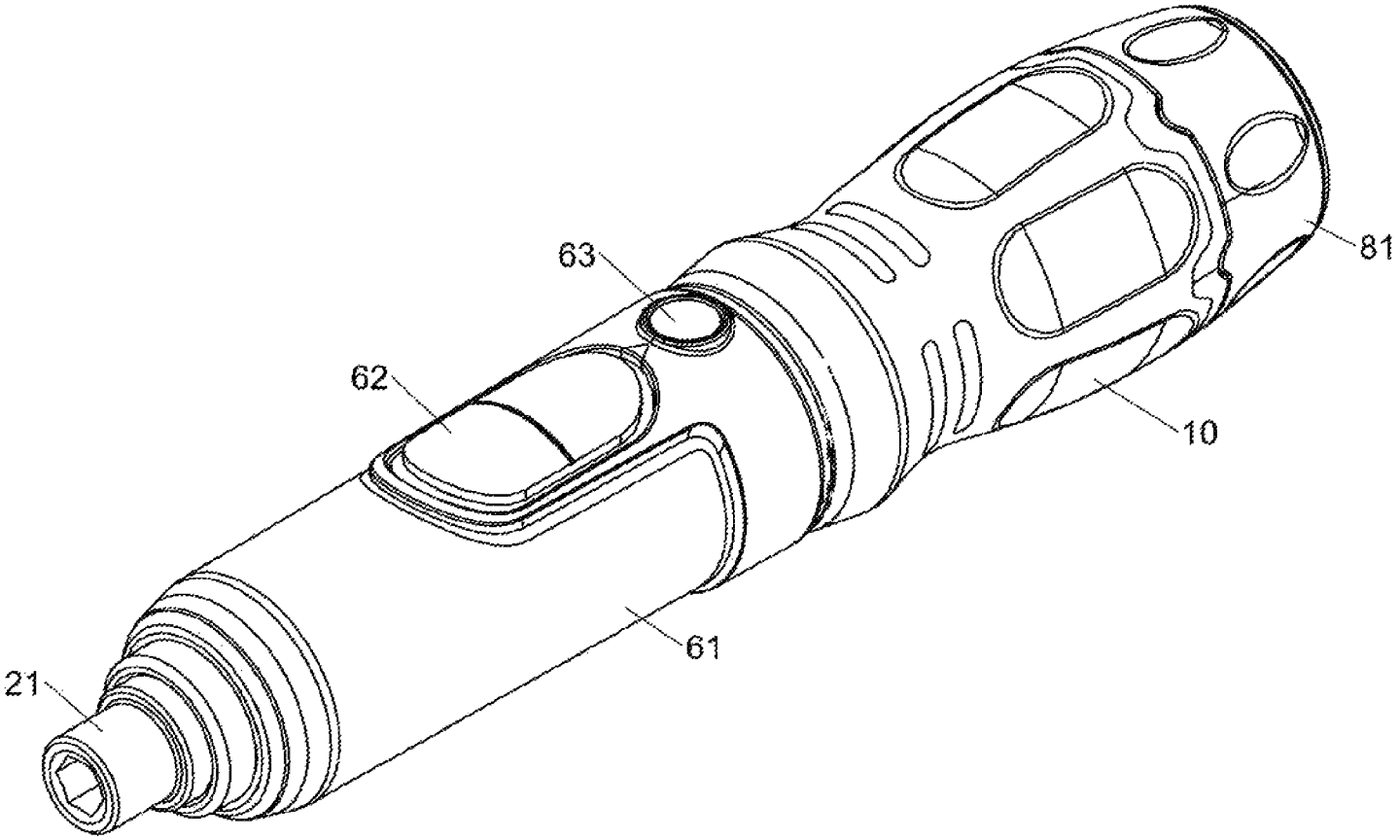
FIG. 9 is a perspective assembly view of the torque structure in accordance with the preferred embodiment of the present invention.

As shown in FIG. 8, the shape of the first recessed portion 821 and the second recessed portion 822 is seen clearly, wherein the circular phantom line represents the inner face of the control ring 82 to indicate the minimum position and the maximum position of the first recessed portion 821 and the second recessed portion 822.

The second elastic member 83 is received in the third locking member 81 and elastically biased against the third locking member 81 or the control ring 82. The second positioning portions 811 are pushed by the second elastic member 83 to contact the first positioning portions 14, so that the third locking member 81 cannot be rotated relative to the first body 10. The second elastic member 83 is compressed when the third locking member 81 is moved.

Figure 17:
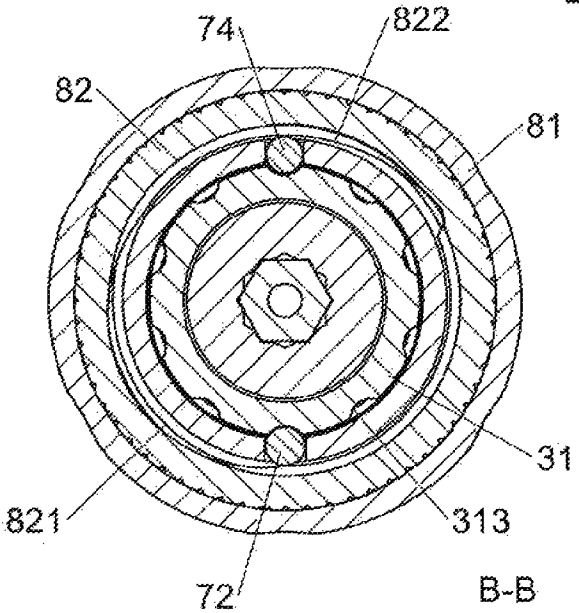
FIG. 17 is a cross-sectional view of the torque structure taken along line B-B as shown in FIG. 16.

In practice, when the control ring 82 is operated to the locking position of the third locking set 80, the minimum position of the first recessed portion 821 aligns with the first perforation 711 as shown in FIG. 17, and the first positioning member 72 is limited by the first recessed portion 821 and positioned in one of the positioning channels 313, so that the first body 10 cannot be rotated relative to the second body 20, while the minimum position of the second recessed portion 822 aligns with the second perforation 713 as shown in FIG. 17, and the second positioning member 74 is limited by the second recessed portion 822 and positioned in one of the positioning channels 313, so that the first body 10 cannot be rotated relative to the second body 20.

Figure 20:
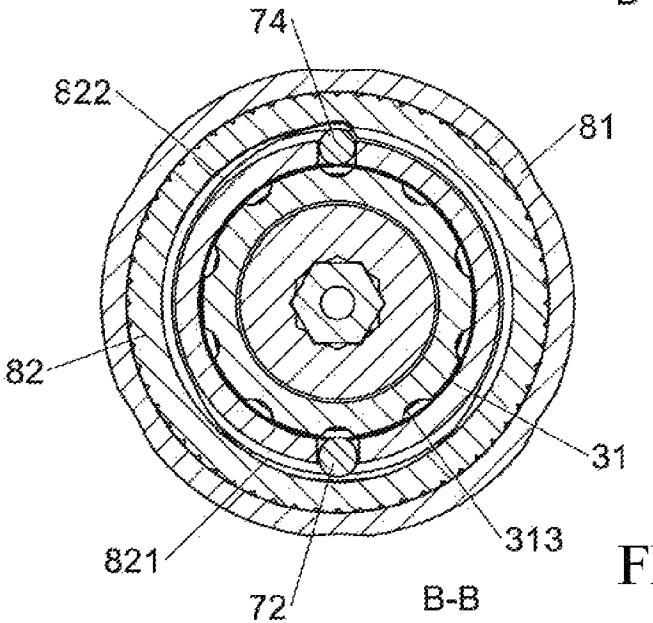
FIG. 20 is a cross-sectional view of the torque structure taken along line B-B as shown in FIG. 19.

On the contrary, when the control ring 82 is operated to the unlocking position of the third locking set 80, the maximum position of the first recessed portion 821 aligns with the first perforation 711 and one of the positioning channels 313 as shown in FIG. 20, and the first positioning member 72 is received in the first perforation 711 and the first recessed portion 821, so that the first positioning member 72 is moved and detached from one of the positioning channels 313, while the maximum position of the second recessed portion 822 aligns with the second perforation 713 as shown in FIG. 20, and the second positioning member 74 is received in the second recessed portion 822, so that the second positioning member 74 is moved and detached from one of the positioning channels 313. At this time, the first positioning member 72 is only restricted by the ring 73, and the first locking member 31 is released from the first positioning member 72, so that the first body 10 is rotated relative to the second body 20, the first locking set 30, and the third body assembly 60, and the first positioning member 72 is moved on the first locking member 31 and positioned in any one of the positioning channels 313. The first positioning member 72 is pushed by the wall of the first locking member 31 during movement to stretch the ring 73. When the first positioning member 72 is moved from one of the positioning channels 313 to another one of the positioning channels 313, the first positioning member 72 is pressed by the restoring force of the ring 73 and moved into another one of the positioning channels 313. When the first positioning member 72 is forced into each of the positioning channels 313, a hitting sound is produced to remind the user that the first positioning member 72 is positioned in one of the positioning channels 313 so as to provide a prompt or hint function.

The fourth body 90 is assembled with the first locking set 30, the adjusting set 40, the second locking set 70, and the third locking set 80. The first body 10 drives the second locking set 70 which drives the fourth body 90 which drives the adjusting set 40. The fourth body 90 is pivotally connected with and covers the third locking set 80 to prevent detachment of the third locking set 80. The second elastic member 83 is biased between the control ring 82 and the fourth body 90.

The fourth body 90 is provided with a second mounting portion 91 mounted on the first mounting portion 414 so that the fourth body 90 is connected with the adjusting member 41 which is driven and rotated by the fourth body 90. The second mounting portion 91 is a preferably hexagonal recess. The fourth body 90 is provided with a fourth screwing portion 92 screwed onto the third screwing portion 714 so that the fourth body 90 is connected with the second locking member 71 without detachment. The third locking set 80 is limited by the fourth body 90 and will not be detached from the second locking member 71. The fourth screwing portion 92 is preferably an external thread.

In practice, the first body 10 is rotated relative to the second body 20 and the third body assembly 60 to drive the second locking set 70 which drives the fourth body 90 which drives the adjusting member 41 so that the adjusting member 41 is rotated relative to the seat 42. The seat 42 is limited by the first limit member 27 so that the seat 42 is moved linearly in the second body 20, and the abutting face 421 is moved to press the first elastic member 28 so as to adjust the degree of compression of the first elastic member 28. At the same time, the seat 42 drives and moves the second limit member 52 which drives the projection 512 to move in the first guide slot 22, so that the indicating member 51 slides in the slideway 612, and the second indicator 511 of the indicating member 51 is moved relative to the indicating portion 621 to indicate the torque value that represents the degree of compression of the first elastic member 28 pressed by the adjusting set 40.

Figure 10:
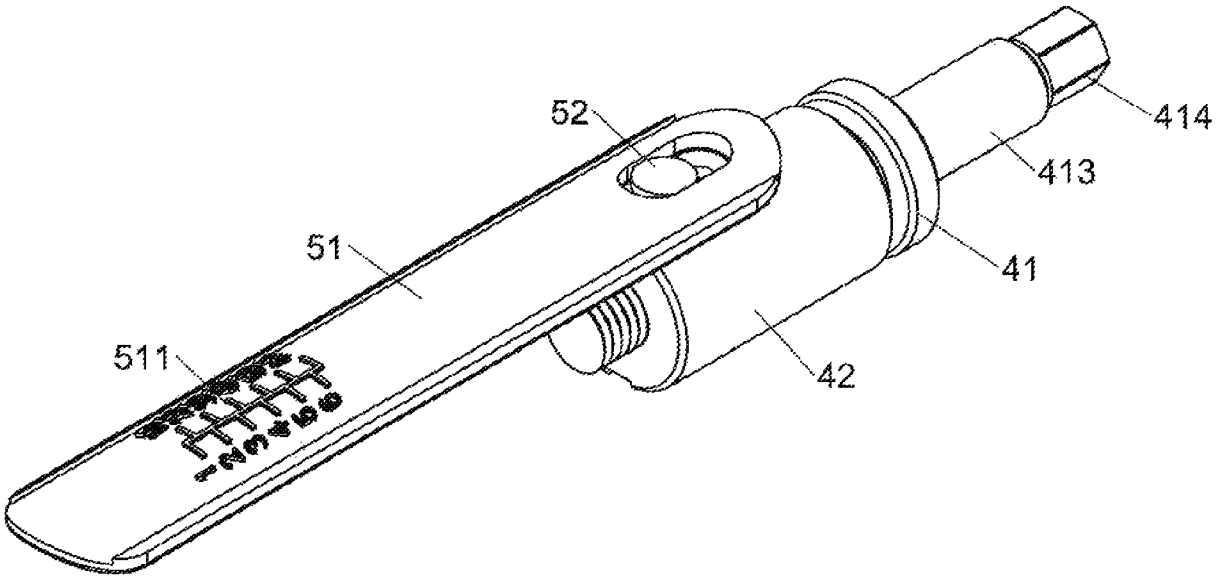
FIG. 10 is a perspective view showing a first operation mode of the torque structure.
Figure 11:
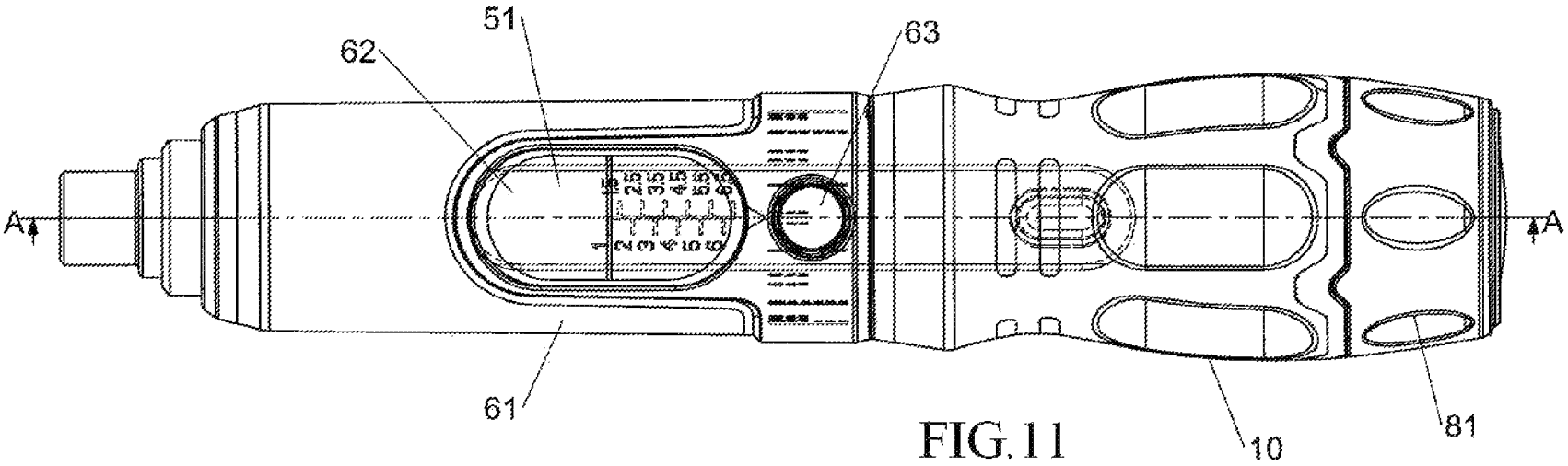
FIG. 11 is a top view of the torque structure that is disposed at the first operation mode.
Figure 12:
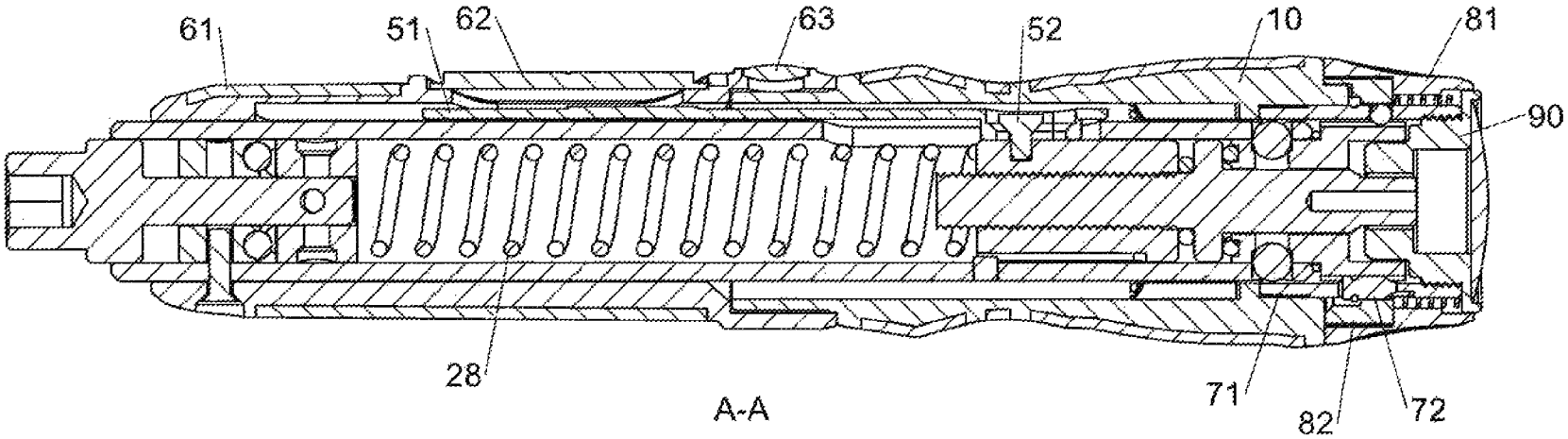
FIG. 12 is a cross-sectional view of the torque structure taken along line A-A as shown in FIG. 11.

In assembly, referring to FIGS. 9-12 with reference to FIGS. 1-8, the second body 20 is pivotally connected with the first body 10, the first locking set 30 is assembled with the second body 20, the adjusting set 40 is assembled with the second body 20 and the first locking set 30, the indication unit 50 is assembled with the first body 10, the second body 20, and the adjusting set 40. As shown in FIGS. 10-12, the torque of the torque structure has the minimum value. The third body assembly 60 is pivotally connected with the first body 10. The third body assembly 60 is secured to the second body 20. The third body assembly 60 covers the indication unit 50. The first body 10 is rotatable relative to the second body 20 and the first locking set 30. The second locking set 70 is assembled with the first body 10 and is rotatable relative to the first locking set 30. The third locking set 80 is assembled with the first body 10 and the second locking set 70. The third locking set 80 is operable between a locking position where the third locking set 80 restricts the second locking set 70 and the first locking set 30 so that the first body 10 cannot be rotated relative to the second body 20 and an unlocking position where the third locking set 80 releases the second locking set 70 and the first locking set 30 so that the first body 10 is rotated relative to the second body 20 and the first locking set 30 to adjust the torque of the torque structure. The fourth body 90 is assembled with the first locking set 30, the adjusting set 40, the second locking set 70, and the third locking set 80. The first body 10 drives the second locking set 70 which drives the fourth body 90 which drives the adjusting set 40.

Figure 13:
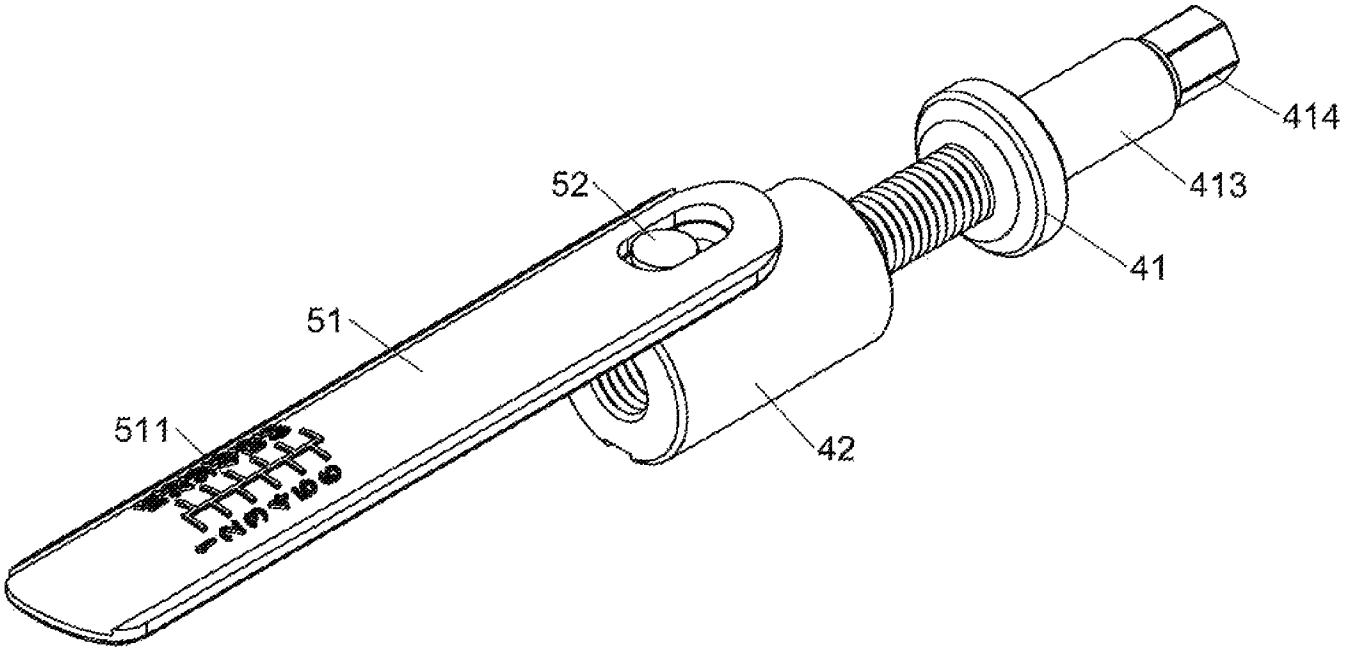
FIG. 13 is a perspective view showing a second operation mode of the torque structure.
Figure 14:
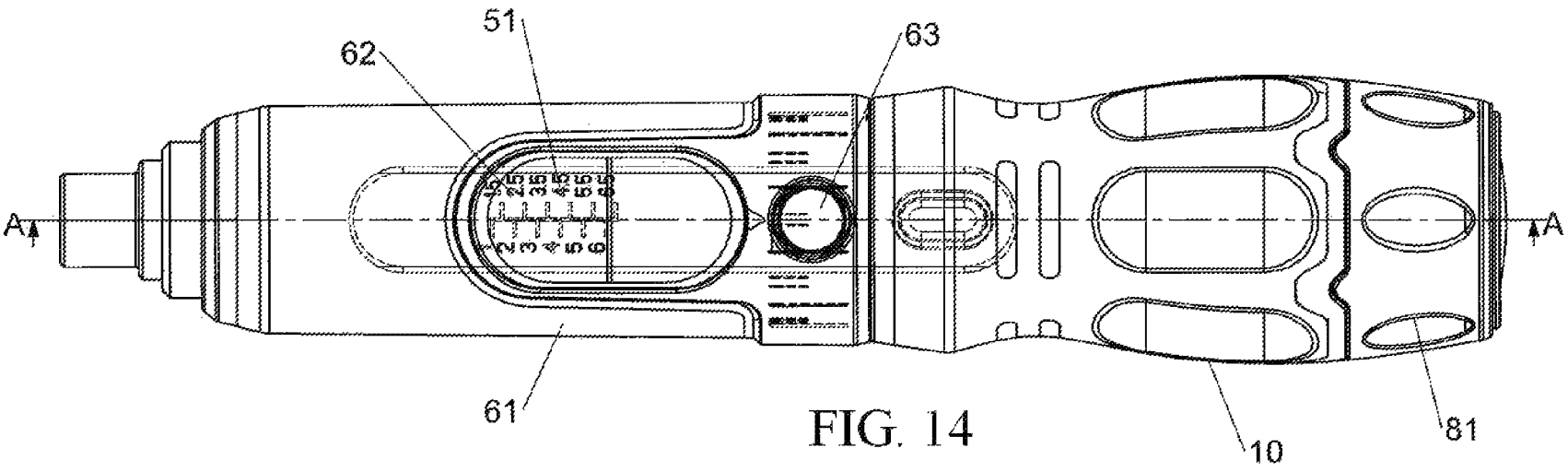
FIG. 14 is a top view of the torque structure that is disposed at the second operation mode.
Figure 15:
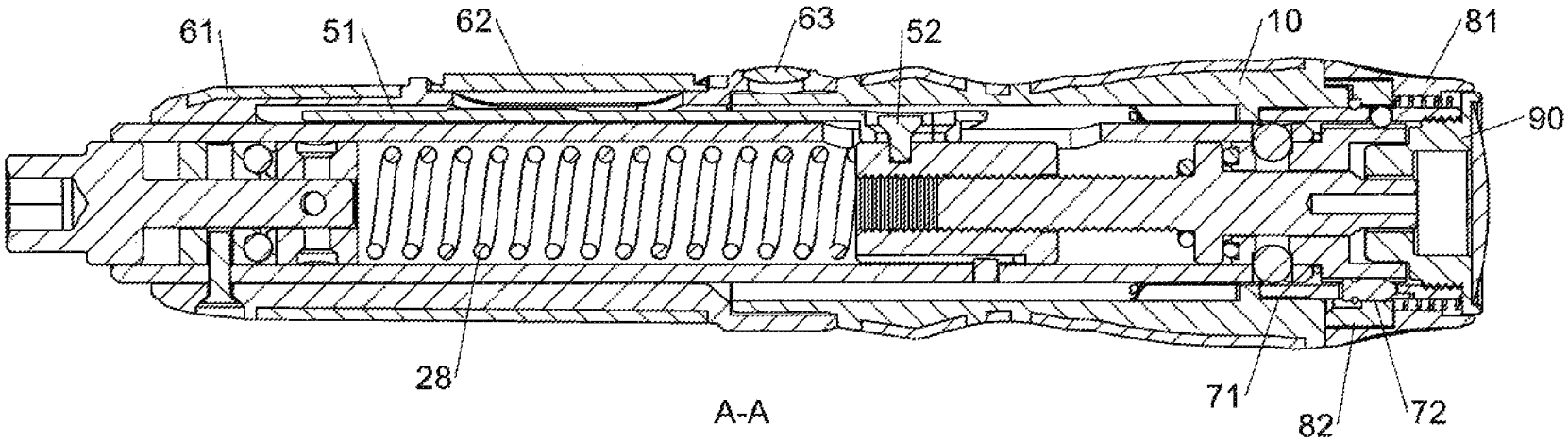
FIG. 15 is a cross-sectional view of the torque structure taken along line A-A as shown in FIG. 14.

In adjustment, referring to FIGS. 13-15 with reference to FIGS. 1-12, the first body 10 is rotated relative to the second body 20 and the third body assembly 60 to drive the second locking set 70 which drives the fourth body 90 which drives the adjusting member 41 so that the adjusting member 41 is rotated relative to the seat 42. The seat 42 is limited by the first limit member 27 so that the seat 42 is moved relative to the adjusting member 41 and moved linearly in the second body 20, and the abutting face 421 is moved to press the first elastic member 28 so as to adjust the degree of compression of the first elastic member 28 and to adjust the torque value of the torque structure. At the same time, the seat 42 drives and moves the second limit member 52 which drives the projection 512 to move in the first guide slot 22, so that the indicating member 51 slides in the slideway 612, and the second indicator 511 of the indicating member 51 is moved relative to the third body 61 and the first cover 62 to align one of the graduations of the second indicator 511 with the indicating portion 621 so as to indicate the torque value that represents the degree of compression of the first elastic member 28 that is compressed by the adjusting set 40. As shown in FIGS. 13-15, the first elastic member 28 is compressed to the minimum length, and the torque of the torque structure has the maximum value.

Figure 16:
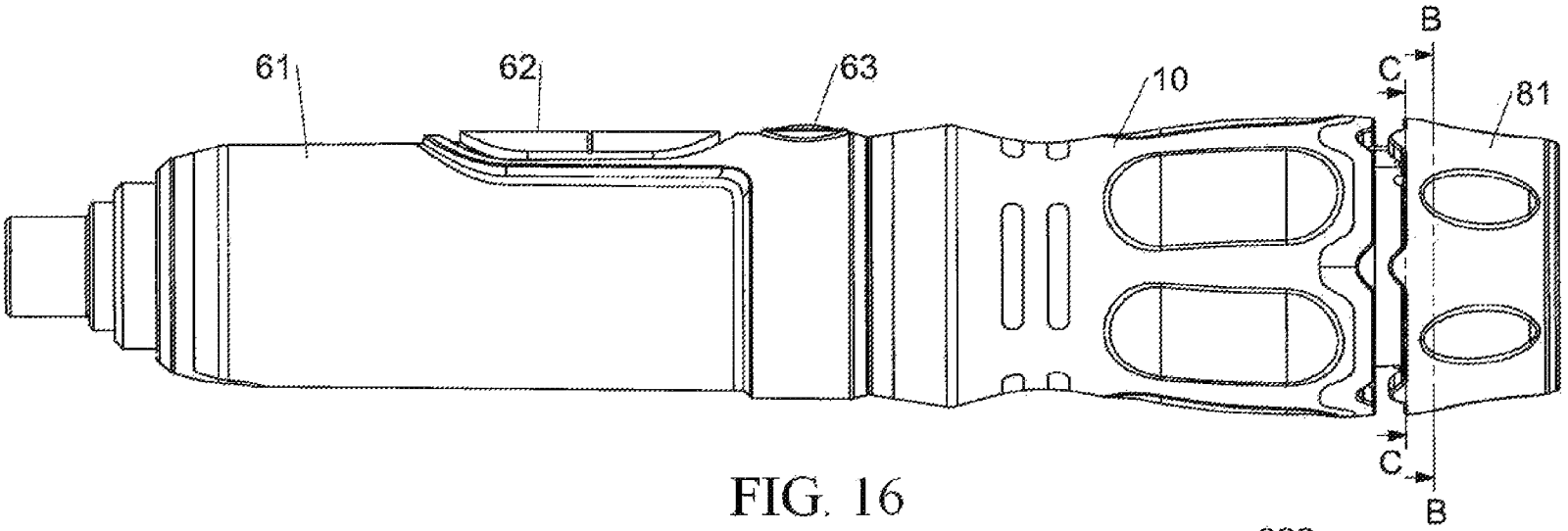
FIG. 16 is a side view of the torque structure in accordance with the preferred embodiment of the present invention.
Figure 18:
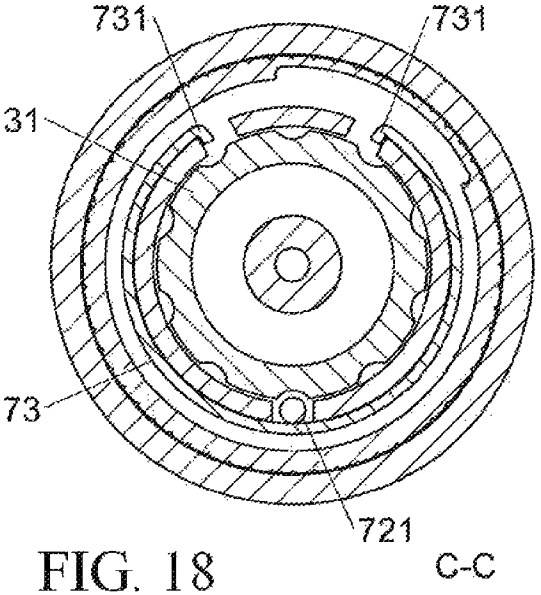
FIG. 18 is a cross-sectional view of the torque structure taken along line C-C as shown in FIG. 16.

In operation, referring to FIGS. 16-18 with reference to FIGS. 1-12, when the control ring 82 is operated to the locking position of the third locking set 80, the minimum position of the first recessed portion 821 aligns with the first perforation 711 as shown in FIG. 17, and the first positioning member 72 is limited by the first recessed portion 821 and positioned in one of the positioning channels 313, so that the first body 10 cannot be rotated relative to the second body 20, while the minimum position of the second recessed portion 822 aligns with the second perforation 713 as shown in FIG. 17, and the second positioning member 74 is limited by the second recessed portion 822 and positioned in one of the positioning channels 313, so that the first body 10 cannot be rotated relative to the second body 20. Thus, the first body 10 is limited by the second locking set 70 and the first locking set 30, so that the first body 10 cannot be rotated relative to the second body 20, the first locking set 30, and the third body assembly 60, and the torque of the torque structure cannot be adjusted.

Figure 19:
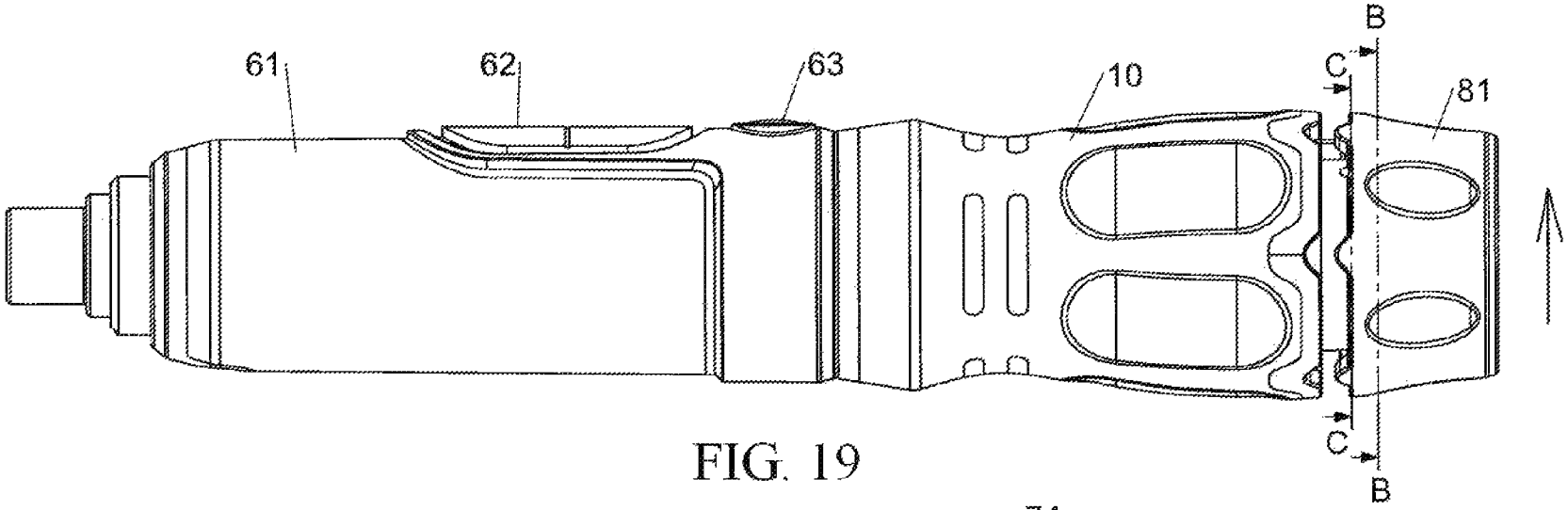
FIG. 19 is a side view of the torque structure that is disposed at another operation mode.
Figure 21:
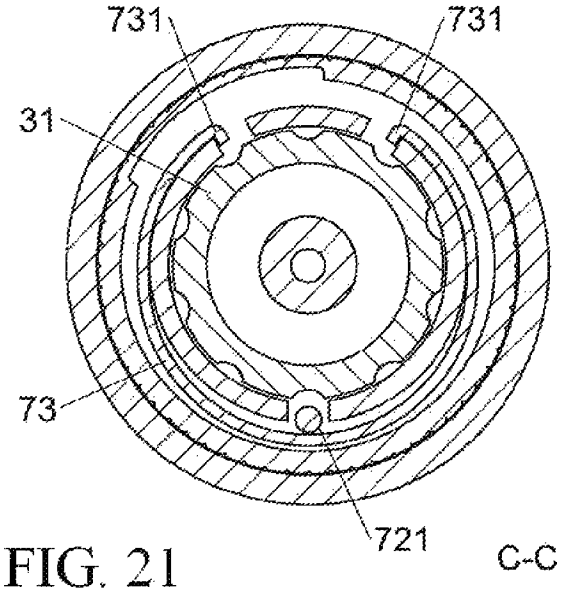
FIG. 21 is a cross-sectional view of the torque structure taken along line C-C as shown in FIG. 19.

On the contrary, referring to FIGS. 19-21 with reference to FIGS. 1-12, when the control ring 82 is operated to the unlocking position of the third locking set 80, the maximum position of the first recessed portion 821 aligns with the first perforation 711 and one of the positioning channels 313 as shown in FIG. 20, and the first positioning member 72 is received in the first perforation 711 and the first recessed portion 821, so that the first positioning member 72 is moved and detached from one of the positioning channels 313, while the maximum position of the second recessed portion 822 aligns with the second perforation 713 as shown in FIG. 20, and the second positioning member 74 is received in the second recessed portion 822, so that the second positioning member 74 is moved and detached from one of the positioning channels 313. At this time, the first positioning member 72 is only restricted by the ring 73, and the first locking member 31 is released from the first positioning member 72, so that the first body 10 is rotatable relative to the second body 20, the first locking set 30, and the third body assembly 60. Thus, the first body 10 can be rotated to drive the adjusting member 41 so as to adjust the length of the first elastic member 28 and to adjust the torque value of the torque structure as shown in FIGS. 13-15.

Figure 22:
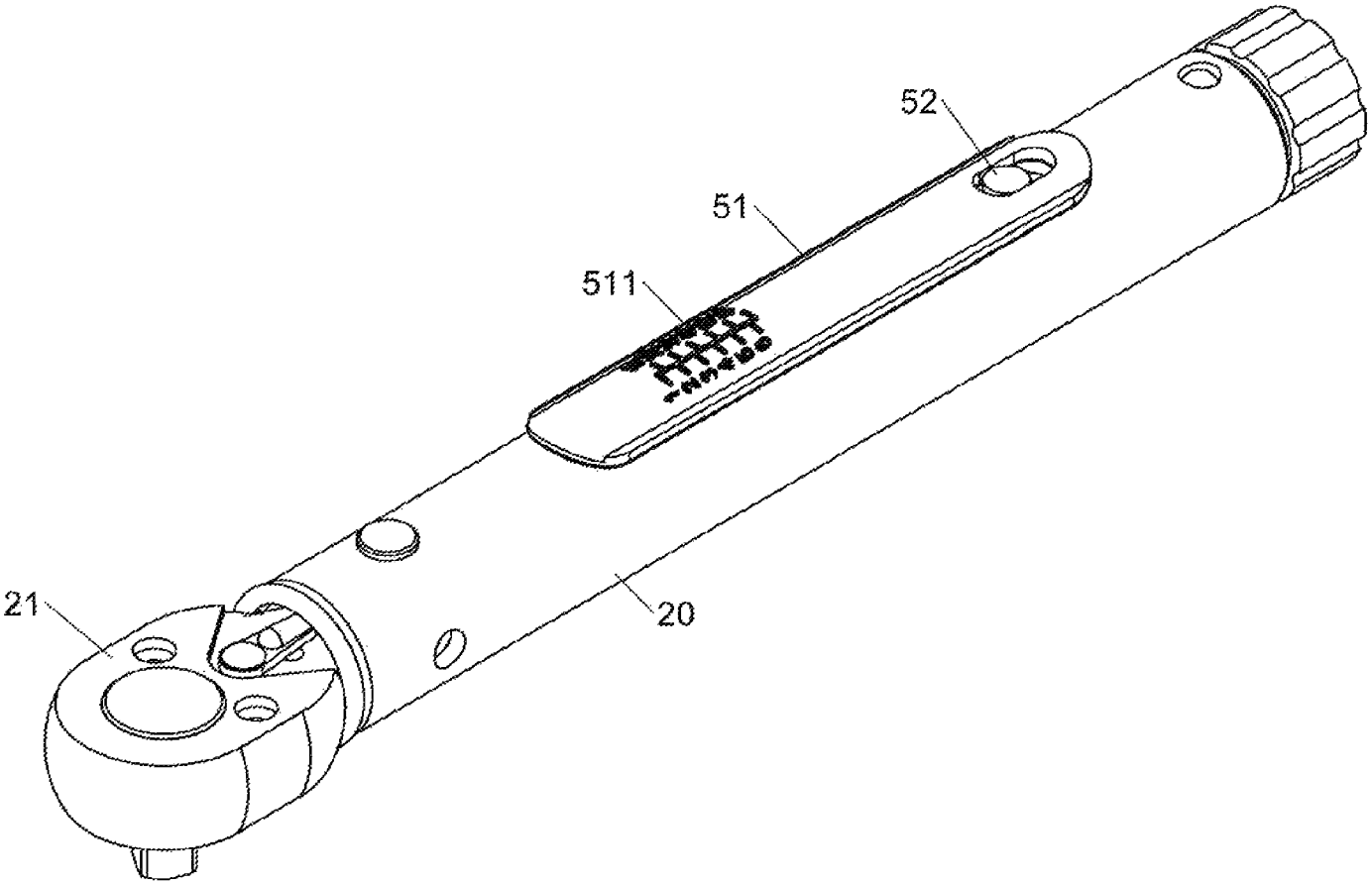
FIG. 22 is a partial perspective view of a torque structure in accordance with a second preferred embodiment of the present invention.

Referring to FIG. 22, the drive portion 21 is a ratchet wrench mechanism including a square head.

Figure 23:
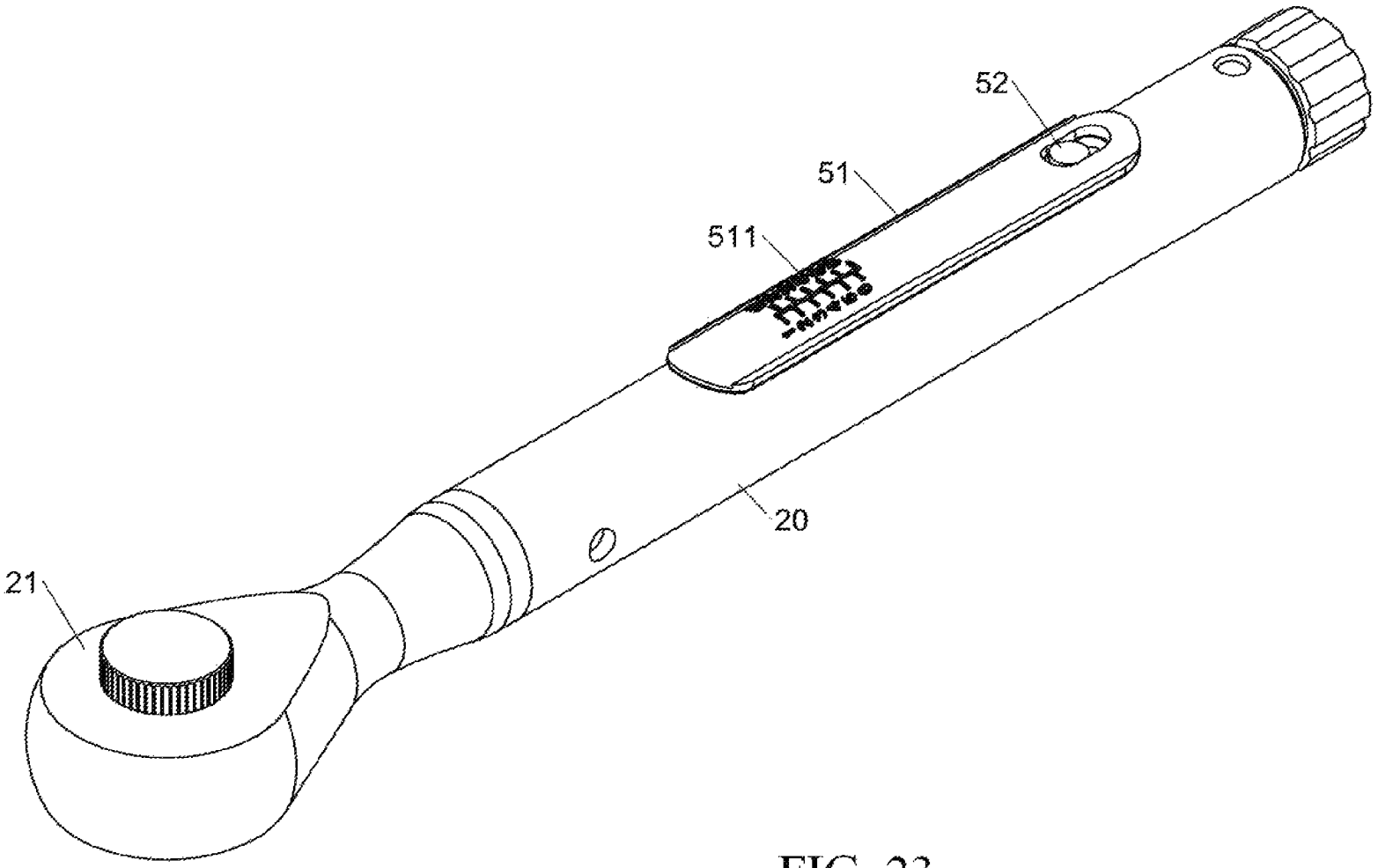
FIG. 23 is a partial perspective view of a torque structure in accordance with a third preferred embodiment of the present invention.

Referring to FIG. 23, the drive portion 21 has an interior provided with a ratchet wrench mechanism that is detachable from the first elastic member 28 to provide a torque slip or tipping function.

In another preferred embodiment of the present invention, the first recess 513 has a shape corresponding to that of the second receiving hole 423. The fourth receiving chamber 617 has a circular shape and has a diameter equal to that of the third receiving chamber 611.

In another preferred embodiment of the present invention, when the control ring 82 is operated to the locking position of the third locking set 80, the first recessed portion 821 misaligns with the first perforation 711, and the first positioning member 72 is pressed by the inner face of the control ring 82, so that the first positioning member 72 is locked in the first perforation 711 and one of the positioning channels 313. Thus, the first body 10 is restricted by the first positioning member 72, the second locking member 71, and the first locking set 30, so that the first body 10 cannot be rotated relative to the second body 20, the first locking set 30, and the third body assembly 60, and the torque of the torque structure cannot be adjusted.

Accordingly, the torque structure has the following advantages.

1. The first body 10 has a larger volume and length to provide a better rotation force when adjusting the torque so that the user directly holds and rotates the first body 10 to satisfy the ergonomic requirement.

2. The first indicator 12 and the indication unit 50 are situated at the mediate position of the torque structure and are close to each other so that the user directly watches the first indicator 12 and the indication unit 50 when holding the first body 10.

3. When the first body 10 drives the adjusting set 40, the first indicator 12 is rotated in the fourth receiving chamber 617 to indicate the torque value. When the indicating member 51 is driven by the adjusting set 40, the indicating member 51 slides in the slideway 612, and the second indicator 511 is moved to indicate the torque value that represents the degree of compression of the first elastic member 28. The first indicator 12 has a plurality of graduations which are spaced and arranged in an annular shape to save the cost of production, and the second indicator 511 has a plurality of graduations which are spaced and arranged linearly to save the cost of production.

4. When each of the graduations of the first indicator 12 aligns with the second hollow 615, the second cover 63 indicates the torque value, and when each of the graduations of the second indicator 511 aligns with the indicating portion 621, the first cover 62 indicates the torque value.

5. The third receiving chamber 611 is provided with a slideway 612, and the indicating member 51 slides linearly in the slideway 612 by guidance of the first guide slot 22.

6. The projection 512 is moved in the first guide slot 22, and a larger volume is provided for mounting the indicating member 51 in the first guide slot 22, so that the indicating member 51 is moved linearly in the slideway 612 without deflection.

7. The first recess 513 has an elongate shape, so that when the indicating member 51 is assembled with the adjusting set 40, the indicating member 51 has a space for slight adjustment, so that the elastic force of the first elastic member 28 has a determined value.

8. The first locking member 31 is a single element to reduce the working cost. The first locking member 31 is formed by injection molding, and is then formed with the second securing portions 312 by drilling.

9. The second elastic member 83 is a spring. When the third locking set 80 is moved away from the first body 10, the second elastic member 83 pushes the third locking set 80 toward the first body 10.

10. When the second mounting portion 91 and the first mounting portion 414 are not fit, the fourth body 90 is rotated slightly, so that the second mounting portion 91 is fit onto the first mounting portion 414.

11. As shown in FIG. 12, the adjusting set 40 is limited by and will not be detached from the first locking set 30. The fourth body 90 is limited by and will not be detached from the second locking set 70. The first body 10 is limited by the second locking set 70 and the fourth body 90 so that the first body 10 is mounted on the second body 20.

12. As shown in FIGS. 12 and 15, the first body 10 is not moved relative to the second body 20 and the third body assembly 60, so that the torque structure has a fixed length that will not be changed by the compression extent of the first elastic member 28 and the torque value of the torque structure.

13. When the third locking set 80 is operated to the unlocking position, the third locking set 80 releases the second locking set 70 and the first locking set 30, so that when the first body 10 is driven, the first body 10 is rotated relative to the second body 20, the first locking set 30, and the third body assembly 60, and drives the fourth body 90 and the adjusting set 40 so as to adjust the torque value of the torque structure.

14. When the third locking set 80 is operated to the unlocking position, and when the first positioning member 72 is moved from one of the positioning channels 313 to another one of the positioning channels 313, the first positioning member 72 is pressed by the restoring force of the ring 73 and moved into another one of the positioning channels 313. When the first positioning member 72 is forced into each of the positioning channels 313, a hitting sound is produced to remind the user that the first positioning member 72 is positioned in one of the positioning channels 313 so as to facilitate the user adjusting the torque value of the torque structure. The control ring 82 is again operated to the locking position when adjustment of the torque is finished.

15. When the third locking set 80 is operated to the locking position, the first body 10 is limited by the second locking set 70 and the first locking set 30, so that the first body 10 cannot be rotated any more, and the torque of the torque structure cannot be adjusted.

16. The balls 33 are received in the ball groove 314 and contacts the spacer 411 to provide a rolling friction when the adjusting member 41 is rotated relative to the first locking member 31.

17. The first washer 34 with an expanding elastic force is biased between the second body 20 and the first locking member 31 to reduce the gap between the second body 20 and the first locking member 31.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque structure comprising:

a first body, a second body, a first limit member, a first elastic member, a first locking set, an adjusting set, an indication unit, a third body assembly, a second locking set, a third locking set, and a fourth body;

wherein:

the first body has an interior provided with a first receiving chamber;

the first body has a first end provided with a first indicator and a second end provided with a second receiving chamber and a plurality of first positioning portions;

the first indicator has a plurality of graduations which are spaced and arranged in an annular shape;

the second receiving chamber is connected to the first receiving chamber;

the second body is pivotally connected with the first body which is rotated relative to the second body;

the second body is partially received in the first receiving chamber and has a first end provided with a drive portion and a first fitting portion and a second end provided with a first guide slot and a plurality of first securing portions;

the first guide slot is hidden in the first receiving chamber;

the first guide slot is arranged between the drive portion and the first securing portions;

the second body is provided with a first receiving hole hidden in the first receiving chamber;

the first receiving hole aligns with the first guide slot;

the first limit member is received in the first receiving hole;

the first elastic member is received in the second body and biased against the drive portion of the second body;

the first locking set is assembled with the second body;

the first locking set is received in the first receiving chamber and includes a first locking member, a plurality of securing members, a plurality of balls, and a first washer;

the first locking member is assembled with the second body;

the first locking member is hidden in the first receiving chamber;

the first locking member has an interior provided with a first pivot portion which;

the first locking member is provided with a plurality of second securing portions aligning with the first securing portions;

the first locking member has a first end provided with a plurality of positioning channels and a second end provided with a ball groove;

the securing members is mounted in the first securing portions and the second securing portions so that the first locking member is secured to the second body;

the balls are rotatably mounted in the ball groove;

the first washer is mounted on the first locking member and located between the second body and the first locking member;

the first washer is arranged between the second end of the second body and the positioning channels;

the first washer is elastic;

the adjusting set is assembled with the second body and the first locking set and pushes the first elastic member;

when the first body is rotated relative to the second body, the adjusting set is driven by the first body;

the indication unit is assembled with the first body, the second body, and the adjusting set;

when the adjusting set is driven by the first body, the indication unit is moved;

the third body assembly is pivotally connected with the first body which is rotatable relative to the second body, the first locking set, and the third body assembly;

the third body assembly is assembled with the second body;

the third body assembly covers the indication unit which is moved in the third body assembly;

the second locking set is assembled with the first body and is rotatable relative to the first locking set;

the second locking set includes a second locking member, a first positioning member, a ring, and a second positioning member;

the second locking member is fit into the second receiving chamber, so that the second locking member is secured to and rotated with the first body;

the second locking member is provided with a first perforation aligning with one of the positioning channels;

the second locking member has an outer face provided with a first annular groove;

the first annular groove is provided with two retaining holes;

the second locking member is provided with a second perforation aligning with one of the positioning channels;

the second perforation aligns with the first perforation;

the two retaining holes are arranged between the first perforation and the second perforation;

the second locking member has an inner face provided with a third screwing portion;

the first positioning member is received in the first perforation;

the first positioning member is provided with a second annular groove;

the ring is mounted on the first annular groove and the second annular groove;

the ring has two retaining portions formed on two ends thereof;

the two retaining portions are retained in the two retaining holes so that the ring is secured to the second locking member;

the first positioning member is limited by the ring;

the second positioning member is received in the second perforation;

the third locking set is assembled with the first body and the second locking set;

the third locking set is operable between a locking position where the third locking set restricts the second locking set and the first locking set so that the first body cannot be rotated relative to the second body and an unlocking position where the third locking set releases the second locking set and the first locking set so that the first body is rotated relative to the second body;

the third locking set is moved relative to the first body so that a distance is defined between the third locking set and the first body;

the third locking set includes a third locking member, a control ring, and a second elastic member;

the third locking member is assembled with the first body and moved and rotated relative to the first body;

the third locking member is provided with a plurality of second positioning portions aligning with the first positioning portions;

the third locking set is disposed at the locking position when the second positioning portions engage the first positioning portions and disposed at the unlocking position when the second positioning portions disengage the first positioning portions;

the third locking member has an interior provided with a fifth receiving chamber;

the control ring is secured to the third locking member and moved and rotated with the third locking member;

the first positioning member, the ring, and the second positioning member are hidden in the control ring;

the control ring is moved and rotated on the second locking member;

the control ring has an inner face provided with a first recessed portion and a second recessed portion;

each of the first recessed portion and the second recessed portion has an arcuate concave shape and has a minimum position and a maximum position;

the second elastic member is received in the third locking member and elastically biased against the third locking member or the control ring;

the second positioning portions are pushed by the second elastic member to contact the first positioning portions;

the second elastic member is compressed when the third locking member is moved;

the fourth body is assembled with the first locking set, the adjusting set, the second locking set, and the third locking set;

the first body drives the second locking set which drives the fourth body which drives the adjusting set;

the fourth body is pivotally connected with and covers the third locking set;

the second elastic member is biased between the control ring and the fourth body;

the fourth body is provided with a second mounting portion mounted on the first mounting portion so that the fourth body is connected with the adjusting member which is driven and rotated by the fourth body;

the fourth body is provided with a fourth screwing portion screwed onto the third screwing portion; and the third locking set is limited by the fourth body.

2. The torque structure as claimed in claim 1, wherein:

the first positioning portions spaced and arranged in an annular shape about an axis of the first body;

the drive portion partially protrudes from the first body;

the positioning channels are arranged in an annular shape about an axis of the first locking member;

each of the positioning channels has an arcuate shape;

the securing members have a number corresponding to that of the first securing portions and that of the second securing portions; and each of the securing members is a ball or a pin.

3. The torque structure as claimed in claim 1, wherein:

the adjusting set includes an adjusting member, a seat, and a second washer;

the adjusting member extends through and is rotatable in the second body and the first pivot portion;

the adjusting member includes a first screwing portion, a spacer, and a second pivot portion;

the spacer is received in the second body and arranged between the first screwing portion and the second pivot portion;

the spacer has a circular shape and rests on the balls to provide a rolling friction when the adjusting member is rotated relative to the first locking member;

the first screwing portion is received in the second body;

the first screwing portion is an external thread and has a diameter less than that of the spacer;

the second pivot portion is pivotally mounted in the first pivot portion and is rotated relative to the first locking member;

the second pivot portion is a circular rod and has a diameter less than that of the spacer;

the second pivot portion is provided with a first mounting portion;

the second pivot portion is arranged between the spacer and the first mounting portion;

the seat is received in the second body and has an end provided with an abutting face that directly or indirectly rests on the first elastic member so that the first elastic member is biased between the drive portion of the second body and the abutting face;

the seat has an interior provided with a second screwing portion screwed with the first screwing portion;

the second screwing portion is an internal thread and is rotated relative to the first screwing portion so that the seat is moved relative to the spacer and is moved linearly in the second body;

the seat is provided with a second receiving hole aligning with the first guide slot;

the second receiving hole has a circular shape and has an axis perpendicular to that of the seat;

the seat is provided with a second guide slot aligning with the first receiving hole;

the first limit member is received in the second guide slot and arranged between the first receiving hole and the second guide slot so that the second guide slot is movable on the first limit member;

the seat is limited by the first limit member and is moved linearly in the second body;

the second guide slot has an elongate shape and extends in a lengthwise direction of the seat;

the second washer is mounted on the first screwing portion and received in the second body;

the second washer is arranged between the spacer of the adjusting member and the seat; and the seat is moved relative to the adjusting member to rest on or leave the second washer.

4. The torque structure as claimed in claim 3, wherein:

the indication unit includes an indicating member and a second limit member;

the indicating member protrudes from the second body and is partially received in the first receiving chamber;

the indicating member is arranged between the first body and the second body and assembled with the adjusting set;

when the adjusting set is driven by the first body, the indicating member is moved linearly outside the second body;

the indicating member is assembled with the seat which drives the indicating member to move linearly outside the second body;

the indicating member is provided with a second indicator having a plurality of graduations which are spaced and arranged linearly;

the indicating member is provided with a projection which is movably mounted in the first guide slot so that the indicating member is moved linearly relative to the second body;

the projection has an oblong shape and has an interior provided with a first recess aligning with the second receiving hole;

the first recess has an elongate shape and has an end provided with a second recess connected to the first recess;

the second recess has an elongate shape and has a length and a diameter more than that of the first recess;

the first recess is arranged between the projection and the second recess;

the second limit member extends through the second receiving hole, the first recess, and the second recess, so that the indicating member is assembled with the seat;

the second limit member is a rivet or a screw member and has as head received in the second recess;

when the first screwing portion is rotated relative to the second screwing portion, the seat is limited by the first limit member and is moved linearly in the second body, so that the abutting face is moved to abut the first elastic member to adjust the degree of compression of the first elastic member;

the seat drives and moves the second limit member which drives the projection to move in the first guide slot; and the indicating member is limited by the second limit member and the projection, so that the indicating member and the second limit member are moved linearly relative to the first body and the second body.

5. The torque structure as claimed in claim 4, wherein:

the third body assembly includes a third body, a first cover, a second cover, and a fitting member;

the third body is assembled with the second body and has a first end provided with a third receiving chamber for partially receiving the second body;

the drive portion partially protrudes from the third body;

the indication unit is received in the first receiving chamber and the third receiving chamber;

the third receiving chamber has a circular shape and has a side provided with a slideway for receiving the indicating member;

the indicating member slides linearly in the slideway by guidance of the first guide slot;

the slideway is connected to the third receiving chamber;

the third body is provided with a first hollow aligning with the second indicator which is moved relative to the first hollow;

the first receiving groove has an elongate shape;

the first hollow is connected to the slideway;

the third body has an exterior provided with a first receiving groove;

the third body has a second end provided with a second hollow and a fourth receiving chamber;

the first body is rotatable relative to the third body to align each of the graduations of the first indicator with the second hollow;

the second hollow has an end provided with a second receiving groove connected to the second hollow;

the fourth receiving chamber is connected to the third receiving chamber and receives the first indicator which is rotatable in the fourth receiving chamber;

the third body is provided with a second fitting portion aligning with the first fitting portion;

the first cover is received in the first receiving groove and covers the first hollow;

the first cover is transparent or translucent and is provided with an indicating portion;

the indicating member is moved relative to the third body to align each of the graduations of the second indicator with the indicating portion;

the second cover is received in the second receiving groove and covers the second hollow;

the second cover is transparent or translucent; and the fitting member extends through the second fitting portion and the first fitting portion so that the third body is secured to the second body.

6. The torque structure as claimed in claim 5, wherein:

the third receiving chamber has a circular shape;

the first hollow is an elongate slot;

the first receiving groove has an elongate shape and has a length and a diameter more than that of the first hollow;

the first hollow is arranged between the slideway and the first receiving groove;

the second hollow is a circular slot;

the second receiving groove has a circular shape and has a diameter less than that of the second hollow;

the fourth receiving chamber has a circular shape and has a diameter less than that of the third receiving chamber;

the second fitting portion is a through hole;

the second cover has a circular shape;

the second cover has a magnifying function; and the second cover is a magnifier.

7. The torque structure as claimed in claim 1, wherein:

the first perforation is an elongate slot;

the second perforation has a circular shape;

the first positioning member is made of metal and has column shape;

the first positioning member is provided with a conic portion;

the conic portion is directed toward the third screwing portion; and the second positioning member is a ball or bead.

8. The torque structure as claimed in claim 1, wherein:

when the control ring is operated to the locking position of the third locking set, the minimum position of the first recessed portion aligns with the first perforation, and the first positioning member is limited by the first recessed portion and positioned in one of the positioning channels, while the minimum position of the second recessed portion aligns with the second perforation, and the second positioning member is limited by the second recessed portion and positioned in one of the positioning channels;

when the control ring is operated to the unlocking position of the third locking set, the maximum position of the first recessed portion aligns with the first perforation and one of the positioning channels, and the first positioning member is received in the first perforation and the first recessed portion, so that the first positioning member is moved and detached from one of the positioning channels, while the maximum position of the second recessed portion aligns with the second perforation, and the second positioning member is received in the second recessed portion, so that the second positioning member is moved and detached from one of the positioning channels;

the first positioning member is only restricted by the ring, and the first locking member is released from the first positioning member, so that the first body is rotated relative to the second body, the first locking set, and the third body assembly, and the first positioning member is moved on the first locking member and positioned in any one of the positioning channels;

the first positioning member is pushed by the wall of the first locking member during movement to stretch the ring;

when the first positioning member is moved from one of the positioning channels to another one of the positioning channels, the first positioning member is pressed by the restoring force of the ring and moved into another one of the positioning channels; and when the first positioning member is forced into each of the positioning channels, a hitting sound is produced.

9. The torque structure as claimed in claim 1, wherein the first recess has a shape corresponding to that of the second receiving hole, and the fourth receiving chamber has a circular shape and has a diameter equal to that of the third receiving chamber.

10. The torque structure as claimed in claim 1, wherein when the control ring is operated to the locking position of the third locking set, the first recessed portion misaligns with the first perforation, and the first positioning member is pressed by the inner face of the control ring and locked in the first perforation and one of the positioning channels, and the first body is restricted by the first positioning member, the second locking member, and the first locking set.

* * * * *